US012140155B2

(12) United States Patent
Watanabe et al.

(10) Patent No.: US 12,140,155 B2
(45) Date of Patent: Nov. 12, 2024

(54) BLOWER

(71) Applicant: DENSO CORPORATION, Kariya (JP)

(72) Inventors: Fuminobu Watanabe, Kariya (JP); Fumiya Ishii, Kariya (JP); Shoichi Imahigashi, Kariya (JP); Kenji Yoshida, Kariya (JP)

(73) Assignee: DENSO CORPORATION, Kariya (JP)

( * ) Notice: Subject to any disclaimer, the term of this patent is extended or adjusted under 35 U.S.C. 154(b) by 255 days.

(21) Appl. No.: 17/674,207

(22) Filed: Feb. 17, 2022

(65) Prior Publication Data

US 2022/0170482 A1 Jun. 2, 2022

Related U.S. Application Data

(63) Continuation of application No. PCT/JP2020/033101, filed on Sep. 1, 2020.

(30) Foreign Application Priority Data

Sep. 27, 2019 (JP) ..... 2019-177460
May 22, 2020 (JP) ..... 2020-089805

(51) Int. Cl.
*F04D 29/44* (2006.01)
*F04D 29/28* (2006.01)
*F04D 29/66* (2006.01)

(52) U.S. Cl.
CPC ..... *F04D 29/44* (2013.01); *F04D 29/281* (2013.01); *F04D 29/667* (2013.01)

(58) Field of Classification Search
CPC ..... F04D 29/44; F04D 29/281; F04D 29/667
USPC ..... 415/203
See application file for complete search history.

(56) References Cited

U.S. PATENT DOCUMENTS 4,566,852 A * 1/1986 Hauser ..... F04D 29/545 416/189
6,599,088 B2 * 7/2003 Stagg ..... F04D 29/164 415/173.6
7,789,622 B2 * 9/2010 Acre ..... F04D 29/526 416/189

(Continued)

FOREIGN PATENT DOCUMENTS

FR 2753495 A1 * 3/1998 ..... F04D 29/164
JP 3921832 B2 5/2007

(Continued)

*Primary Examiner* — Hung Q Nguyen
*Assistant Examiner* — Anthony Donald Taylor, Jr.
(74) *Attorney, Agent, or Firm* — Harness, Dickey & Pierce, P.L.C.

(57) ABSTRACT

A fan includes blades and a side plate. The side plate includes a fan ring portion having a cylindrical shape centered on a fan axis. A guide part that is annular is arranged on one side of the fan ring portion in the axial direction and forms a suction port through which the air sucked into the fan passes. A communication path that allows an upstream space located on the one side in the axial direction with respect to the guide part to communicate with a gap between the fan ring portion and the guide part is formed outside the guide part in a radial direction of the fan axis. The fan ring portion is located outside in the radial direction with respect to an innermost peripheral portion of the guide part located on an innermost side in the radial direction.

24 Claims, 24 Drawing Sheets

(56) References Cited

U.S. PATENT DOCUMENTS

| | | | | |
|---|---|---|---|---|
| 8,277,180 | B2 * | 10/2012 | Blass | F04D 29/164 416/189 |
| 9,011,094 | B2 * | 4/2015 | McPeek | F01P 5/04 415/213.1 |
| 9,334,877 | B2 * | 5/2016 | Nicholls | F04D 29/58 |
| 9,890,791 | B2 * | 2/2018 | Innocenti | F04D 29/403 |
| 9,903,387 | B2 * | 2/2018 | Stagg | F04D 29/164 |
| 2010/0111667 | A1 * | 5/2010 | Stagg | F04D 29/441 415/191 |
| 2018/0335048 | A1 | 11/2018 | Conrad et al. | |
| 2019/0368374 | A1 * | 12/2019 | Hu | F04D 29/685 |

FOREIGN PATENT DOCUMENTS

| | | | | | |
|---|---|---|---|---|---|
| JP | 2010133297 | A | | 6/2010 | |
| JP | 201891207 | A | | 6/2018 | |
| JP | 2018091207 | A | * | 6/2018 | F04D 29/42 |
| JP | 2021134734 | A | | 9/2021 | |

* cited by examiner

BLOWER

CROSS REFERENCE TO RELATED APPLICATION

The present application is a continuation application of International Patent Application No. PCT/JP2020/033101 filed on Sep. 1, 2020, which designated the U.S. and claims the benefit of priority from Japanese Patent Application No. 2019-177460 filed on Sep. 27, 2019 and Japanese Patent Application No. 2020-89805 filed on May 22, 2020. The entire disclosures of all of the above applications are incorporated herein by reference.

TECHNICAL FIELD

The present disclosure relates to a blower that causes a flow of air.

BACKGROUND ART

In a centrifugal blower, an air outlet portion of a bell mouth is fitted inside an air suction side end of a shroud, which constitutes a part of a turbo fan impeller, with a gap from the air suction side end. A seal wall having a U-shaped cross section is provided on an outer peripheral side of the air outlet portion of the bell mouth, and the seal wall covers the air suction side end of the shroud so as to cover the air suction side end.

SUMMARY

According to one aspect of the present disclosure, a blower includes:

a fan that includes a plurality of blades arranged side by side in a circumferential direction around a fan axis, and a side plate that includes a fan ring portion having a cylindrical shape centered on the fan axis and to which one end of each of the blades is connected, the fan rotating around the fan axis to blow out air sucked from one side in an axial direction of the fan axis with respect to the fan ring portion through an inside of the fan ring portion into between the blades; and a guide part that is annular and arranged on the one side in the axial direction as compared with the fan ring portion and forms, inside the guide part, a suction port through which the air sucked into the fan passes.

A communication path that allows an upstream space located on the one side in the axial direction with respect to the guide part to communicate with a gap between the fan ring portion and the guide part is formed outside the guide part in a radial direction of the fan axis, and the fan ring portion is located outside in the radial direction with respect to an innermost peripheral portion located on an innermost side in the radial direction in the guide part.

DESCRIPTION OF EMBODIMENTS

Figure 1:
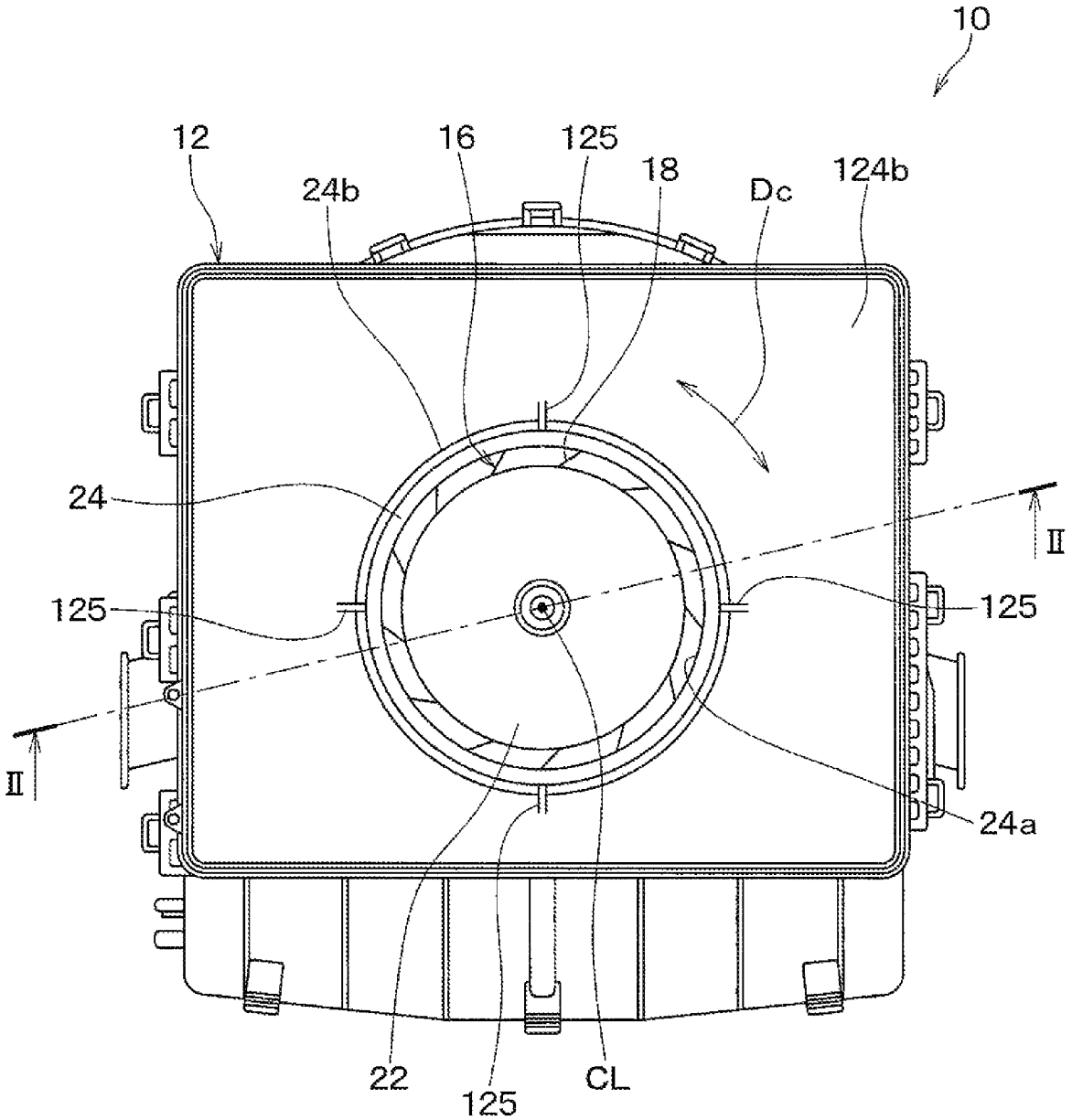
FIG. 1 is an external view schematically illustrating a blower according to a first embodiment and illustrates the blower as viewed in a direction from one side to the other side in a fan axial direction.

To begin with, examples of relevant techniques will be described.

A centrifugal blower has been conventionally known. In the centrifugal blower, an air outlet portion of a bell mouth is fitted inside an air suction side end of a shroud, which constitutes a part of a turbo fan impeller, with a gap from the air suction side end. A seal wall having a U-shaped cross section is provided on an outer peripheral side of the air outlet portion of the bell mouth, and the seal wall covers the air suction side end of the shroud so as to cover the air suction side end.

By providing the seal wall in this manner, backflow of air passing through the outside of the shroud is suppressed, fan efficiency is improved, and separation of a blade negative pressure surface due to interference with a main flow is also suppressed.

However, as a result of examination by the inventors, it has been found that in the centrifugal blower, an intersection angle between a direction of backflow air and a direction of the main flow is still large in a backflow outlet portion where the backflow air merges with the main flow. In the centrifugal blower, the effect of reducing the flow rate of the backflow air and the effect of reducing noise caused by the backflow air are also insufficient. In short, the centrifugal blower has room for improving disadvantages caused by the backflow air. As a result of detailed studies by the inventors, the above has been found.

The present disclosure provides a blower capable of reducing noise of a fan and improving efficiency of the fan.

According to one aspect of the present disclosure, a blower includes:

a fan that includes a plurality of blades arranged side by side in a circumferential direction around a fan axis, and a side plate that includes a fan ring portion having a cylindrical shape centered on the fan axis and to which one end of each of the blades is connected, the fan rotating around the fan axis to blow out air sucked from one side in an axial direction of the fan axis with respect to the fan ring portion through an inside of the fan ring portion into between the blades; and a guide part that is annular and arranged on the one side in the axial direction as compared with the fan ring portion and forms, inside the guide part, a suction port through which the air sucked into the fan passes.

A communication path that allows an upstream space located on the one side in the axial direction with respect to the guide part to communicate with a gap between the fan ring portion and the guide part is formed outside the guide part in a radial direction of the fan axis, and the fan ring portion is located outside in the radial direction with respect to an innermost peripheral portion located on an innermost side in the radial direction in the guide part.

In this manner, an air flow is also generated in the communication path accompanying rotation of the fan. Thus, the air flow in the communication path merges with a backflow air flow that passes outside the side plate and flows backward from an outlet side toward an inlet side of the fan. Due to the merging of the two air flows, the intersection angle between the flow direction of the backflow air and the direction of the main flow can be reduced in the backflow outlet portion where the backflow air merges into the main flow that passes through the suction port and flows between the blades. Consequently, it is possible to reduce the noise of the fan and improve efficiency of the fan.

Parenthesized reference numerals attached to respective components and the like indicate an example of a correspondence relationship between the components and the like and specific components and the like described in embodiments described later.

Hereinafter, embodiments will be described with reference to the drawings. In the following embodiments, the same or equivalent parts are denoted by the same reference numerals in the drawings.

First Embodiment

Figure 2:
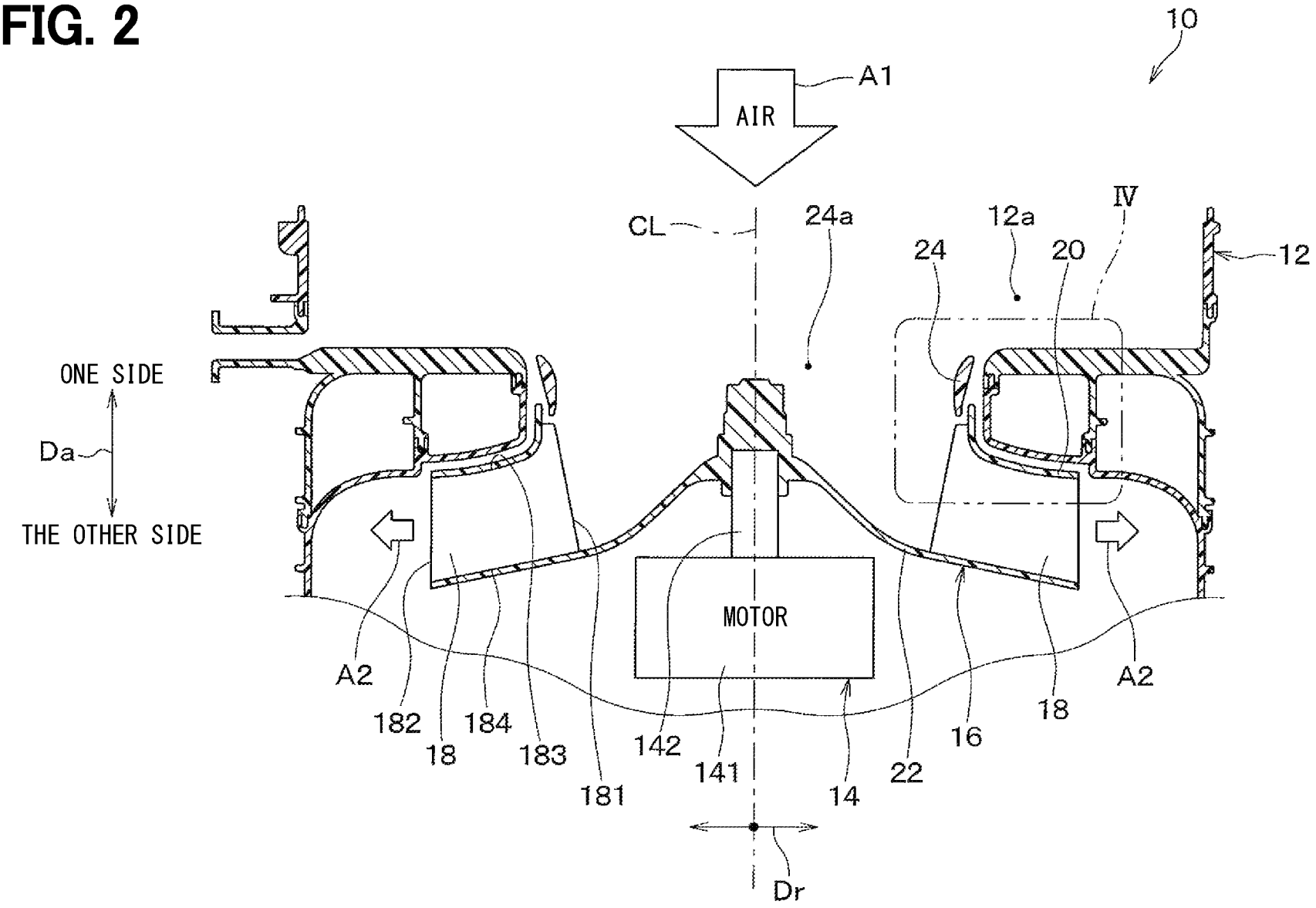
FIG. 2 is a cross-sectional view taken along line II-II in FIG. 1 in the first embodiment, and is a view illustrating a longitudinal cross section obtained by cutting the blower along a virtual plane including a fan axis.

A blower 10 of the present embodiment is employed, for example, in a vehicle air conditioning unit that performs air conditioning in a vehicle interior. As illustrated in FIGS. 1 and 2, the blower 10 includes a case 12, an electric motor 14, a fan 16 that is an impeller, and a guide part 24.

Figure 3:
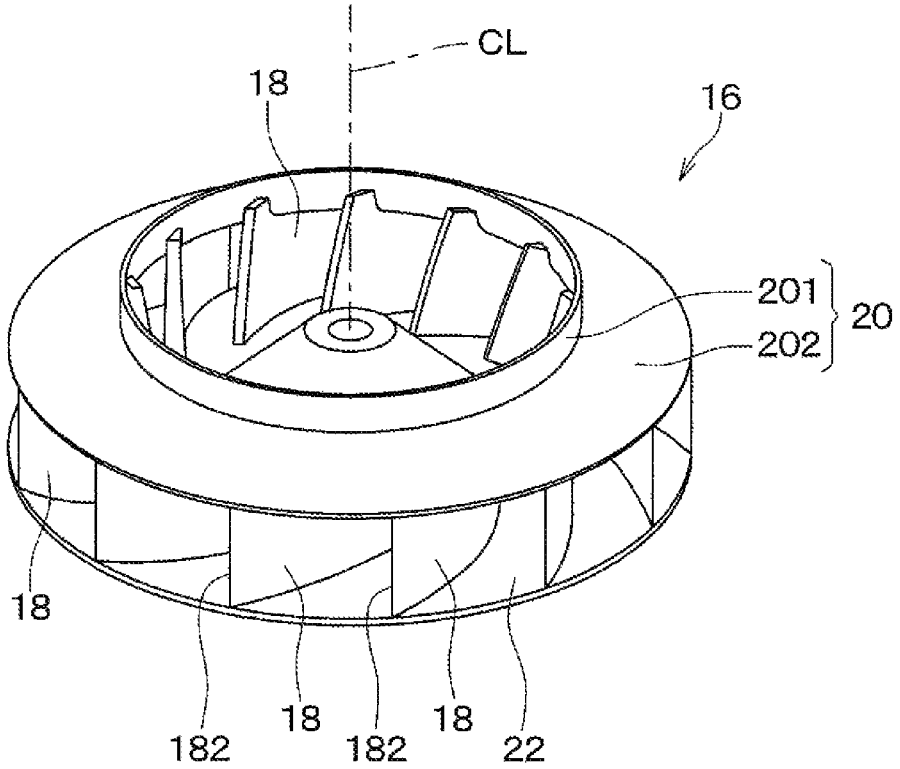
FIG. 3 is a perspective view illustrating a fan included in the blower according to the first embodiment alone.

As illustrated in FIGS. 2 and 3, the fan 16 is a centrifugal fan (specifically, a turbo fan) that rotates around a fan axis CL. Therefore, the blower 10 of the present embodiment is a centrifugal blower.

The fan 16 rotates around the fan axis CL to suck air from one side in an axial direction Da of the fan axis CL as indicated by an arrow A1 and blow the sucked air to the outside in a radial direction Dr of the fan axis CL as indicated by an arrow A2. The axial direction Da of the fan axis CL is, in other words, the axial direction Da of the fan 16, the radial direction Dr of the fan axis CL is, in other words, the radial direction Dr of the fan 16, and a circumferential direction Dc (see FIG. 1) around the fan axis CL is, in other words, a circumferential direction Dc of the fan 16. In the description of the present embodiment, the axial direction Da of the fan axis CL is also referred to as a fan axial direction Da, the radial direction Dr of the fan axis CL is also referred to as a fan radial direction Dr, and the circumferential direction Dc around the fan axis CL is also referred to as a fan circumferential direction Dc.

As illustrated in FIGS. 1 and 2, the case 12 is a non-rotating member that does not rotate. The case 12 is made of, for example, resin, and is configured by combining a plurality of resin molded members. The case 12 accommodates the fan 16 in the case 12 and holds the electric motor 14.

The electric motor 14 rotates the fan 16 by receiving power supply. The electric motor 14 has a motor body 141 that does not rotate and a motor rotation shaft 142 that projects from the motor body 141 to the one side in the fan axial direction Da.

The motor rotation shaft 142 rotates around the fan axis CL. On the other hand, the motor body 141 is fitted in a part of the case 12 and fixed to the case 12.

Figure 4:
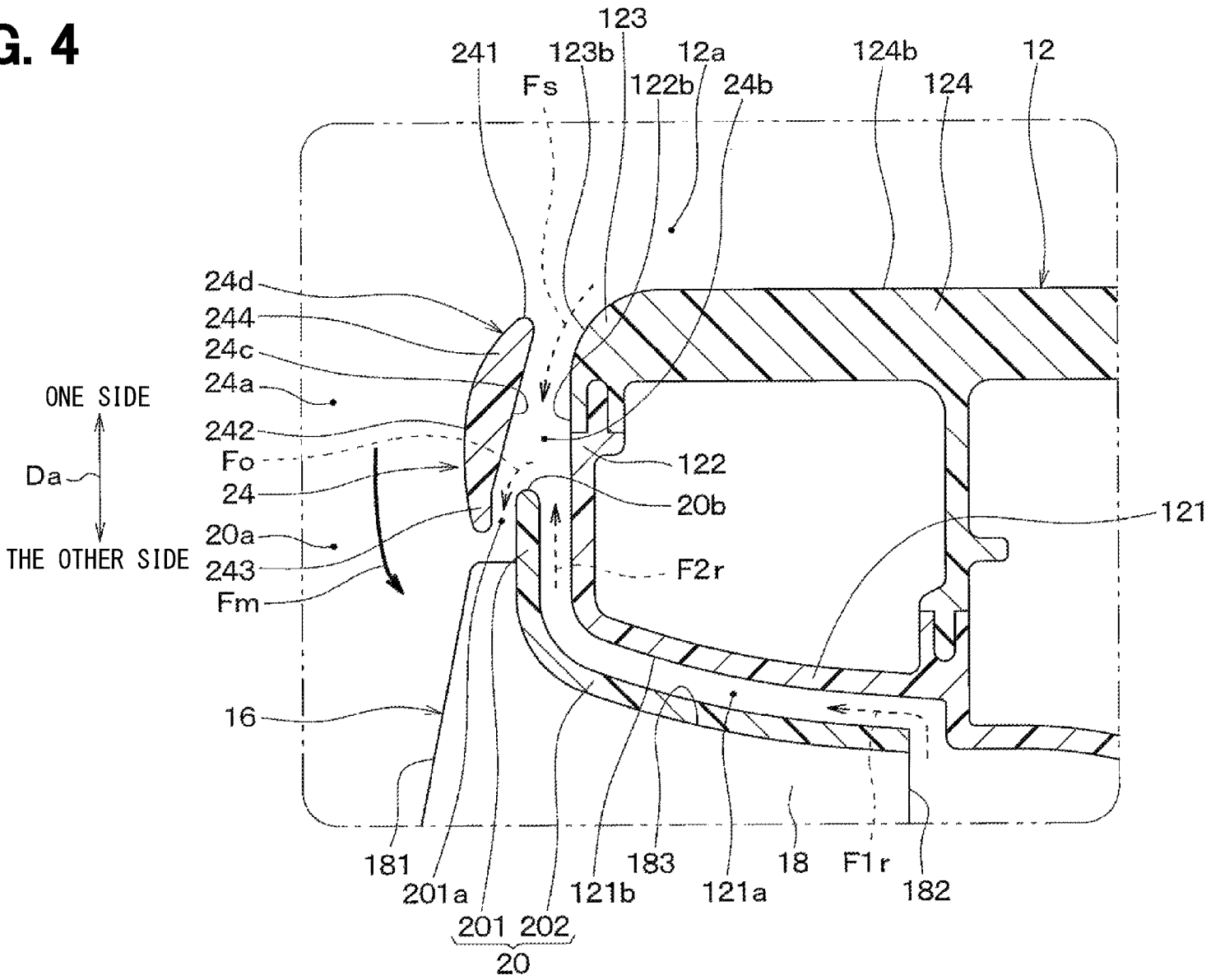
FIG. 4 is an enlarged cross-sectional view illustrating an enlarged IV portion of FIG. 2.

The fan 16 is made of resin, for example, and includes a plurality of blades 18, a side plate 20, and a main plate 22. The blades 18 is arranged side by side in the fan circumferential direction Dc at intervals from each other. Air is circulated between the blades 18 from inside to outside in the fan radial direction Dr as the fan 16 rotates. In the present embodiment, an air flow passing through a suction port 24*a* as described later and flowing between the blades 18 may be referred to as a main flow. In FIG. 4, an arrow Fm indicates the main flow.

As illustrated in FIGS. 2 to 4, each of the blades 18 has a blade leading edge 181 that is an upstream end provided on an upstream side in an air flow direction, and a blade trailing edge 182 that is a downstream end provided on a downstream side in the air flow direction. Each of the blades 18 has one end 183 of the blade provided on the one side in the fan axial direction Da and the other end 184 of the blade provided on the other side in the fan axial direction Da.

The main plate 22 of the fan 16 has a disk shape centered on the fan axis CL, and is fixed to the motor rotation shaft 142 at a center portion. Thus, the entire fan 16 rotates integrally with the motor rotation shaft 142.

The main plate 22 expands in the fan radial direction Dr while being inclined with respect to the fan axis CL such that it is located farther on the other side in the fan axial direction Da as it is more outside in the fan radial direction Dr. This is because the air flow is guided such that the air flow in the other side direction in the fan axial direction Da is directed outward in the fan radial direction Dr.

The main plate 22 is connected to each of the blades 18 on the side opposite to the side plate 20. In short, the other end 184 of the blade of each of the blades 18 is connected to the main plate 22.

The side plate 20 of the fan 16 has a ring shape centered on the fan axis CL. The side plate 20 is provided on the one side in the fan axial direction Da with respect to the blades 18, and is connected to each of the blades 18. In short, the one end 183 of the blade of each of the blades 18 is connected to the side plate 20.

An intake hole 20*a* into which air from the one side in the fan axial direction Da is sucked is formed inside the side plate 20.

The side plate 20 includes a fan ring portion 201 and a downstream expanded diameter portion 202. The fan ring portion 201 is arranged on the one side in the fan axial direction Da and inside in the fan radial direction Dr with respect to the downstream expanded diameter portion 202. That is, the fan ring portion 201 is arranged upstream of the downstream expanded diameter portion 202 in a flow direction of the main flow.

The fan ring portion 201 has, as one end of the fan ring portion 201, one end 20*b* of the side plate located at an end on one side in the fan axial direction Da in the side plate 20. Regarding the positional relationship between the one end 20*b* of the side plate and the blades 18, the blades 18 are arranged with a gap from the one end 20*b* of the side plate toward the other side in the fan axial direction Da.

The fan ring portion 201 surrounds the entire circumference of the intake hole 20*a* and has a cylindrical shape centered on the fan axis CL. That is, the intake hole 20*a* is formed inside the fan ring portion 201 in the side plate 20. For example, the fan ring portion 201 of the present embodiment has a cylindrical shape or a substantially cylindrical shape.

As illustrated in FIGS. 3 and 4, the downstream expanded diameter portion 202 of the side plate 20 extends from the other end that the fan ring portion 201 has on the other side in the fan axial direction Da. The downstream expanded diameter portion 202 is formed to expand outward in the fan radial direction Dr from the other end of the fan ring portion 201. Specifically, the downstream expanded diameter portion 202 expands in the fan radial direction Dr while being inclined with respect to the fan axis CL such that it is located farther on the other side in the fan axial direction Da as it is more outside in the fan radial direction Dr.

The fan 16 configured in this manner rotates around the fan axis CL to suck air from the one side in the fan axial direction Da with respect to the fan ring portion 201 to the blades 18 through the inside of the fan ring portion 201. At the same time, the fan 16 blows the air sucked between the blades 18 to the outside in the fan radial direction Dr.

As illustrated in FIG. 4, the case 12 has a side plate facing portion 121, a guide outside arrangement portion 122, a suction corner portion 123, and an air guide portion 124. Since the case 12 does not rotate as described above, the side plate facing portion 121, the guide outside arrangement portion 122, the suction corner portion 123, and the air guide portion 124 also do not rotate.

The side plate facing portion 121 of the case 12 is arranged on the side opposite to the side of the blades 18 with respect to the side plate 20, and is formed so as to form a gap 121*a* with the side plate 20 and to expand along the side plate 20. Thus, the side plate facing portion 121 has a side plate facing surface 121*b* facing the gap 121*a* between the side plate 20 and the side plate facing portion 121 and facing the side plate 20.

The guide outside arrangement portion 122 of the case 12 is provided on the one side in the fan axial direction Da with respect to the fan ring portion 201 of the side plate 20, and is arranged outside the fan ring portion 201 in the fan radial direction Dr. The guide outside arrangement portion 122 is provided on the one side in the fan axial direction Da with respect to the side plate facing portion 121.

The guide outside arrangement portion 122 is formed so as to surround the fan axis CL over the entire circumference around the fan axis CL. Thus, the guide outside arrangement portion 122 has an inward surface 122*b* that faces inward in the fan radial direction Dr.

The inward surface 122*b* of the guide outside arrangement portion 122 has a cylindrical inner surface shape extending in the fan axial direction Da around the fan axis CL. The inward surface 122*b* may be a tapered surface as long as the inward surface faces inward in the fan radial direction Dr, but in the present embodiment, the inward surface is a cylindrical inner surface with the fan radial direction Dr being a normal direction. Further, the inward surface 122*b* is connected to the side plate facing surface 121*b*, and is continuously connected without being bent from the side plate facing surface 121*b*.

The air guide portion 124 of the case 12 is provided on the one side in the fan axial direction Da with respect to the guide outside arrangement portion 122. Further, the air guide portion 124 is formed so as to expand in the fan radial direction Dr on the outside in the fan radial direction Dr with respect to the inward surface 122*b* of the guide outside arrangement portion 122. Thus, the air guide portion 124 has an air guide surface 124*b* facing the one side in the fan axial direction Da. The air guide surface 124*b* may be inclined with respect to the fan axis CL as long as the air guide surface faces the one side in the fan axial direction Da, but in the present embodiment, the air guide surface has a planar shape with the fan axial direction Da being a normal direction.

The suction corner portion 123 of the case 12 is arranged between the guide outside arrangement portion 122 and the air guide portion 124, and connects the guide outside arrangement portion 122 and the air guide portion 124. The suction corner portion 123 has, as a surface portion of the suction corner portion 123, a surface connecting portion 123*b* as a bell mouth surface connecting the air guide surface 124*b* and the inward surface 122*b* between the air guide surface 124*b* and the inward surface 122*b*. That is, the suction corner portion 123 is configured as a bell mouth portion in which the bell mouth surface is formed.

The surface connecting portion 123*b* formed as the bell mouth surface extends from the other side to the one side in the fan axial direction Da while bending so as to expand outward in the fan radial direction Dr. That is, the surface connecting portion 123*b* is a curved convex surface curving convexly in a longitudinal cross section (that is, a longitudinal cross section of FIG. 4) obtained by cutting the case 12 along a plane including the fan axis CL. In the longitudinal cross section of FIG. 4, the surface connecting portion 123*b* is provided as a portion where a radius of curvature is locally reduced with respect to the inward surface 122*b* and the air guide surface 124*b*.

The surface connecting portion 123*b* is connected to each of the inward surface 122*b* and the air guide surface 124*b*, and is continuously connected without being bent from each of the inward surface 122*b* and the air guide surface 124*b*.

The guide part 24 is formed in an annular shape and is arranged on the one side in the fan axial direction Da as compared with the fan ring portion 201 of the side plate 20. The guide part 24 forms, inside this guide part 24, a suction port 24*a* through which air sucked into the fan 16 passes.

A communication path 24*b* is formed outside the guide part 24 in the fan radial direction Dr. Since the guide part 24 is provided inside in the fan radial direction Dr with respect to the guide outside arrangement portion 122 of the case 12, a gap between the guide part 24 and the guide outside arrangement portion 122 is a communication path 24*b*. The communication path 24*b* allows an upstream space 12*a* located on the one side in the fan axial direction Da with respect to the guide part 24 to communicate with a gap 201*a* (in other words, a gap flow path 201*a*) between the fan ring portion 201 and the guide part 24. The air guide surface 124*b* of the case 12 faces the upstream space 12*a*.

A cross-sectional shape of the guide part 24 illustrated in the longitudinal cross section of FIG. 4, that is, a cross-sectional shape of the guide part 24 obtained by cutting along a plane including the fan axis CL is a plate shape extending in the fan axial direction Da. Therefore, as illustrated in FIGS. 1 and 4, the guide part 24 has an annular shape (for example, a ring shape) extending in the fan axial direction Da.

Specifically, as illustrated in FIG. 4, the cross-sectional shape of the guide part 24 obtained by cutting along the plane including the fan axis CL is an airfoil shape extending in the fan axial direction Da. The airfoil shape of the guide part 24 has a positive pressure surface 24*c* arranged outside in the fan radial direction Dr and a negative pressure surface 24*d* arranged inside in the fan radial direction Dr, with the one side in the fan axial direction Da being a front leading edge of the airfoil shape. Therefore, the guide part 24 of the present embodiment functions as a stationary blade portion arranged on the upstream side in the flow direction of the main flow with respect to the blades 18 rotating around the fan axis CL.

The guide part 24 is arranged on the other side in the fan axial direction Da with respect to the air guide surface 124*b* of the case 12. Specifically, the guide part 24 has one end 241 on the one side in the fan axial direction Da, and the one end 241 is located on the other side in the fan axial direction Da with respect to the air guide surface 124*b* of the case 12. The air guide surface 124*b* guides air to the suction port 24*a*.

The guide part 24 has an innermost peripheral portion 242 located on an innermost side in the fan radial direction Dr in the guide part 24. The fan ring portion 201 of the side plate 20 is located outside in the fan radial direction Dr with respect to the innermost peripheral portion 242. At the same time, as compared with the side plate facing surface 121*b* of the case 12, the fan ring portion 201 is located inside in the fan radial direction Dr with respect to the side plate facing surface 121*b*.

As illustrated in FIG. 1, the communication path 24*b* between the guide part 24 and the guide outside arrangement portion 122 is provided over the entire circumference around the fan axis CL. For example, the guide part 24 is molded as a component different from the case 12 and is connected and fixed to the case 12 via a plurality of guide support portions 125 connecting the guide part 24 and the case 12. Therefore, the guide part 24 is also a non-rotating member similar to the case 12.

Although the communication path 24*b* is divided in the fan circumferential direction Dc by the plurality of guide support portions 125, there is no difference in that the communication path is provided over the entire circumference around the fan axis CL. The guide support portion 125 is connected to, for example, a suction corner portion 123 (see FIG. 4) in the case 12.

As illustrated in FIG. 4, the guide part 24 has an overlapping portion 243 and an extension portion 244 which are continuously connected to each other without a step. The overlapping portion 243 is provided so as to overlap with the inside in the fan radial direction Dr of the fan ring portion 201 of the side plate 20, and is arranged so as to face the fan ring portion 201 with a radial gap. The extension portion 244 extends from the overlapping portion 243 to the one side in the fan axial direction Da, and is provided on the one side in the fan axial direction Da with respect to the fan ring portion 201.

As described above, according to the present embodiment, as illustrated in FIG. 4, the communication path 24*b* that allows the upstream space 12*a* to communicate with the gap 201*a* between the fan ring portion 201 and the guide part 24 is formed outside the guide part 24 in the fan radial direction Dr. The fan ring portion 201 of the side plate 20 is located outside in the fan radial direction Dr with respect to the innermost peripheral portion 242 of the guide part 24.

Here, when the fan 16 rotates, along with the rotation of the fan 16, a main flow is generated as indicated by an arrow Fm, and a backflow air flow that passes through the gap 121*a* located outside the side plate 20 as indicated by arrows F1*r* and F2*r* and flows backward from the outlet side toward the inlet side of the fan 16 is also generated. Furthermore, since the communication path 24*b* is provided in the present embodiment, an air flow from the upstream space 12*a* toward the gap 201*a* between the fan ring portion 201 and the guide part 24 as indicated by an arrow Fs is also generated in the communication path 24*b*.

Thus, the backflow air flow indicated by the arrow F2*r* merges with the air flow in the communication path 24*b* indicated by the arrow Fs, and then merges with the main flow through the gap 201*a* between the fan ring portion 201 and the guide part 24 as indicated by an arrow Fo. In the present embodiment, due to the merging of the two air flows indicated by the arrows F2*r* and Fs, the intersection angle between the direction of the backflow air flow and the direction of the main flow can be made smaller than that of a centrifugal blower of a comparison example in the backflow outlet portion where the backflow air merges into the main flow. Consequently, it is possible to reduce noise of the fan 16 and improve efficiency of the fan 16.

Describing specifically, in the centrifugal blower of the comparison example, the backflow air flow has a speed component in the fan circumferential direction Dc, and reduction of the speed component in the fan circumferential direction Dc is insufficient. Therefore, noise is generated due to the intersection between the backflow air flow and the main flow. On the other hand, in the blower 10 of the present embodiment, the backflow air having passed through the gap 121*a* between the side plate 20 and the side plate facing portion 121 as indicated by the arrows F1*r* and F2*r* in FIG. 4 collides with the air having passed through the communication path 24*b* as indicated by the arrow Fs in FIG. 4. Thus, the blower 10 of the present embodiment can reduce the speed component in the fan circumferential direction Dc that the backflow air has as compared with the centrifugal blower of the comparison example.

In the blower 10 of the present embodiment, the backflow air having a reduced speed component in the fan circumferential direction Dc merges into the main flow indicated by the arrow Fm from the gap 201*a* between the fan ring portion 201 and the guide part 24 by the negative pressure on an air flow upstream side of the blades 18. Thus, the flow direction of the backflow air at the time of merging substantially coincides with the flow direction of the main flow, and noise can be reduced.

According to the present embodiment, as illustrated in FIG. 4, the guide part 24 has the overlapping portion 243 and the extension portion 244 extending from the overlapping portion 243 to the one side in the fan axial direction Da. The overlapping portion 243 is provided so as to overlap with the fan ring portion 201 on an inside in the fan radial direction Dr. The extension portion 244 is provided on the one side in the fan axial direction Da with respect to the fan ring portion 201.

Thus, the air flow after the merging of the air flow passing through the communication path 24*b* and the backflow air flow flowing backward through the outside of the side plate 20 can be guided along the direction of the main flow indicated by the arrow Fm in the gap 201*a* between the overlapping portion 243 and the fan ring portion 201.

According to the present embodiment, the overlapping portion 243 that the guide part 24 has is arranged so as to face the fan ring portion 201 with a gap. Therefore, it is easy to guide the air flow passing through the gap 201*a* between the overlapping portion 243 and the fan ring portion 201 along the fan axial direction Da.

According to the present embodiment, as illustrated in FIGS. 1 and 4, the communication path 24*b* is provided over the entire circumference around the fan axis CL. Therefore, the merging of the air flow passing through the communication path 24*b* and the backflow air flow flowing backward as indicated by the arrows F1*r* and F2*r* can be uniformly generated over the entire circumference around the fan axis CL. Thus, for example, it is possible to suppress noise and the like that may be generated due to unevenness in the merging of the air flow passing through the communication path 24*b* and the backflow air flow.

According to the present embodiment, as illustrated in FIG. 4, the cross-sectional shape of the guide part 24 obtained by cutting along the plane including the fan axis CL is an airfoil shape having the positive pressure surface 24*c* arranged outside in the fan radial direction Dr and the negative pressure surface 24*d* arranged inside in the fan radial direction Dr. Therefore, the operation of the positive pressure surface 24*c* increases the pressure (in other words, atmospheric pressure) of the air passing through the communication path 24*b* as indicated by the arrow Fs. The air pressure on the downstream side of the backflow air flow indicated by the arrows F1*r* and F2*r* is also increased by the merging of the air flow passing through the communication path 24*b* and the backflow air flow.

Consequently, the pressure difference between an air pressure on the upstream side (in other words, an air pressure at a backflow inlet) and an air pressure on the downstream side (in other words, an air pressure at a backflow outlet) of the backflow air flow is reduced, so that the air flow rate of the backflow air flow can be reduced. In the present embodiment, an outer end in the fan radial direction Dr in the gap 121*a* between the side plate 20 and the side plate facing portion 121 corresponds to the backflow inlet, and an end on the one side in the fan axial direction Da in the gap 121*a* corresponds to the backflow outlet. The atmospheric pressure mentioned here is specifically a static pressure of air.

Furthermore, since the air flow rate of the backflow air flow can be reduced, the air flow rate flowing between the blades 18 can be reduced when the blower 10 operates at the same operating point. Consequently, a phenomenon that the air flow between the blades 18 is separated from the side plate 20 can be suppressed to a small extent, which leads to a reduction in noise of the fan 16 and an improvement in efficiency of the fan 16.

According to the present embodiment, as illustrated in FIG. 4, the blower 10 includes the guide outside arrangement portion 122, and the guide outside arrangement portion 122 is provided on the one side in the fan axial direction Da with respect to the fan ring portion 201 and on the outside in the fan radial direction Dr with respect to the guide part 24. The cross-sectional shape (that is, the cross-sectional shape of the guide part 24 illustrated in FIG. 4) of the guide part 24 obtained by cutting along the plane including the fan axis CL is a plate shape extending in the fan axial direction Da, and a gap between the guide part 24 and the guide outside arrangement portion 122 is the communication path 24*b*. Therefore, it is possible to provide the communication path 24*b* by, for example, adding the guide part 24 to the guide outside arrangement portion 122 while securing the maximum opening area of the suction port 24*a* through which the main flow passes.

Second Embodiment

Next, a second embodiment will be described. In the present embodiment, differences from the above-described first embodiment will be mainly described. Parts that are the same as or equivalent to those in the above-described embodiment will be omitted or simplified. The same applies to the description of the embodiments as described later.

Figure 5:
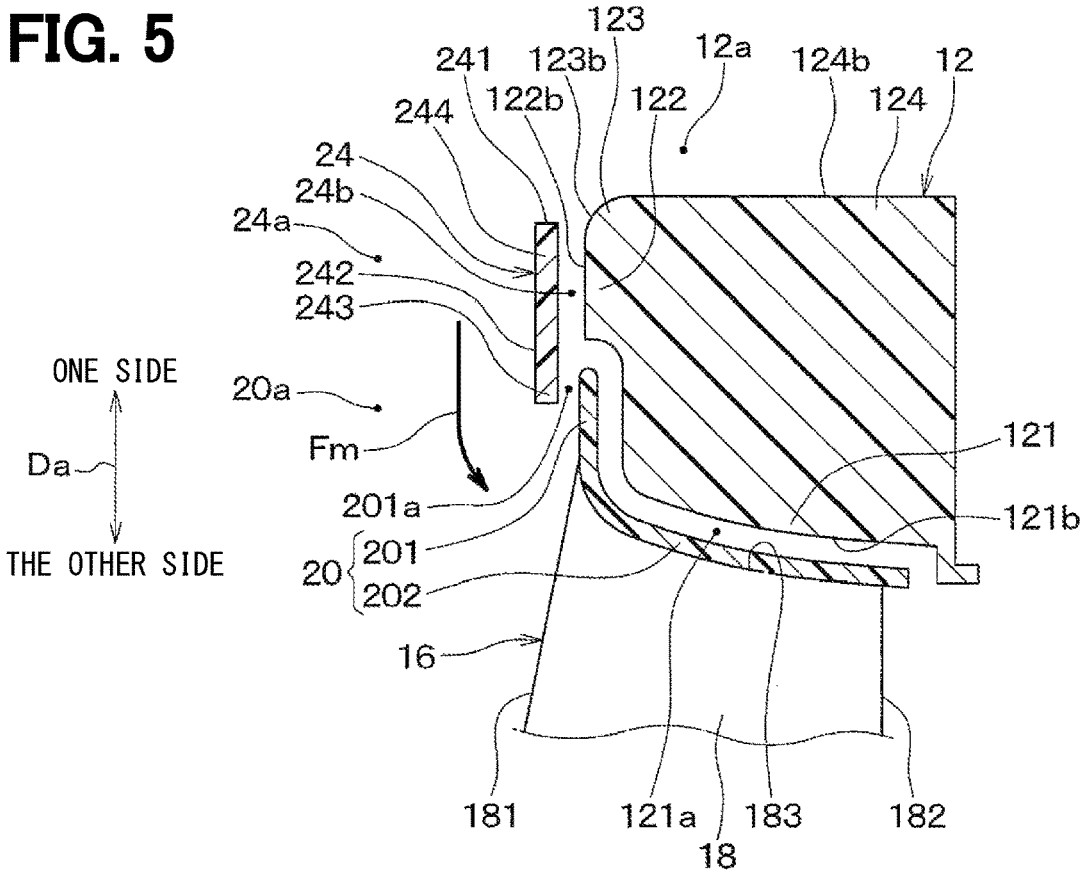
FIG. 5 is an enlarged cross-sectional view illustrating a portion corresponding to an IV portion in FIG. 2 in an enlarged manner in a second embodiment, and is a view corresponding to FIG. 4.

As illustrated in FIG. 5, in the present embodiment, the cross-sectional shape of the guide part 24 obtained by cutting along the plane including the fan axis CL is not an airfoil shape. The cross-sectional shape of the guide part 24 is a plate shape extending in the fan axial direction Da along the fan axis CL. That is, the guide part 24 has a cylindrical shape extending along the fan axial direction Da.

As in the first embodiment, the inward surface 122*b* of the guide outside arrangement portion 122 has a cylindrical inner surface shape extending in the fan axial direction Da around the fan axis CL. However, the inward surface 122*b* is not continuously connected to the side plate facing surface 121*b*, and is connected to the side plate facing surface 121*b* with a step interposed between the inward surface and the side plate facing surface 121*b*. The inward surface 122*b* is arranged inside in the fan radial direction Dr with respect to the side plate facing surface 121*b*.

The present embodiment is similar to the first embodiment except for the above description. In the present embodiment, effects exhibited by components common to the above-described first embodiment can be obtained as in the first embodiment.

Third Embodiment

Next, a third embodiment will be described. In the present embodiment, differences from the above-described first embodiment will be mainly described.

Figure 6:
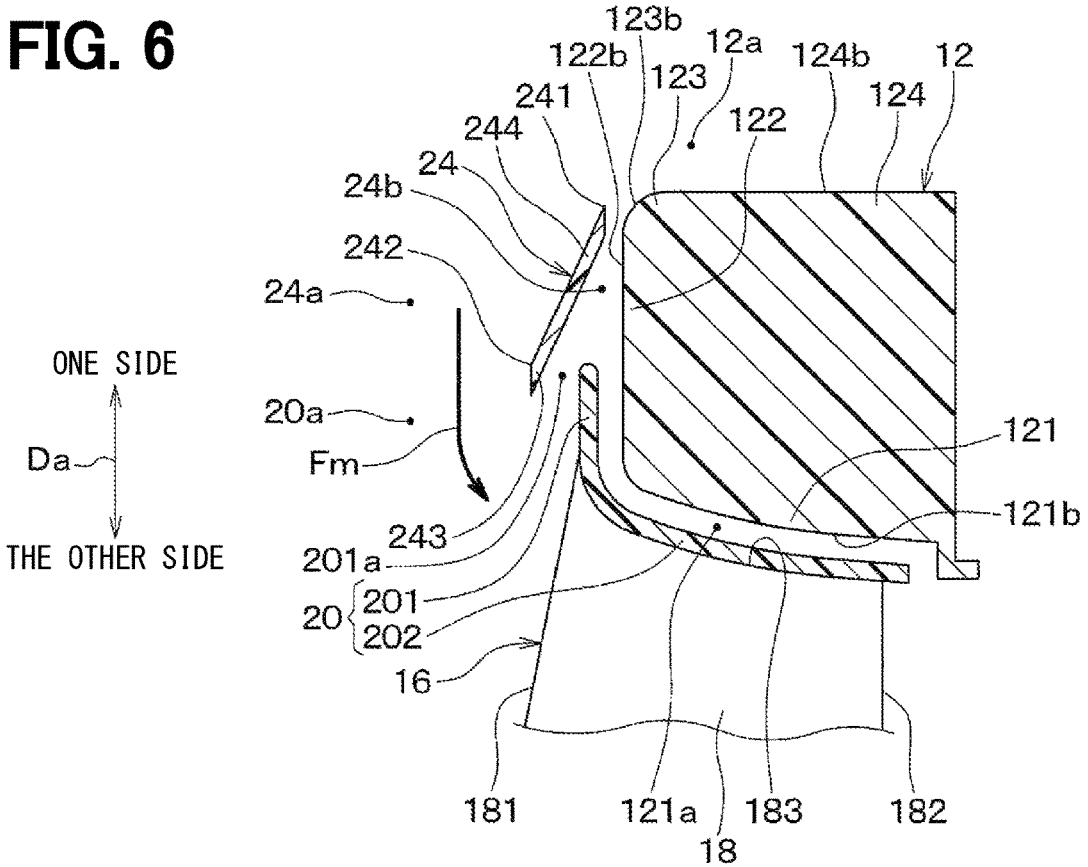
FIG. 6 is an enlarged cross-sectional view illustrating a portion corresponding to the IV portion in FIG. 2 in an enlarged manner in a third embodiment, and is a view corresponding to FIG. 4.

As illustrated in FIG. 6, in the present embodiment, the cross-sectional shape of the guide part 24 obtained by cutting along the plane including the fan axis CL is not an airfoil shape. The cross-sectional shape of the guide part 24 is a plate shape extending in the fan axial direction Da and inclined with respect to the fan axis CL. Specifically, the cross-sectional shape of the guide part 24 is a plate shape that is located more outside in the fan radial direction Dr as it is farther on the one side in the fan axial direction Da.

That is, the guide part 24 has a cylindrical shape extending in the fan axial direction Da, and is tapered to expand more in diameter as it is farther on the one side in the fan axial direction Da.

The present embodiment is similar to the first embodiment except for the above description. In the present embodiment, effects exhibited by components common to the above-described first embodiment can be obtained as in the first embodiment.

Fourth Embodiment

Next, a fourth embodiment will be described. In the present embodiment, differences from the above-described first embodiment will be mainly described.

Figure 7:
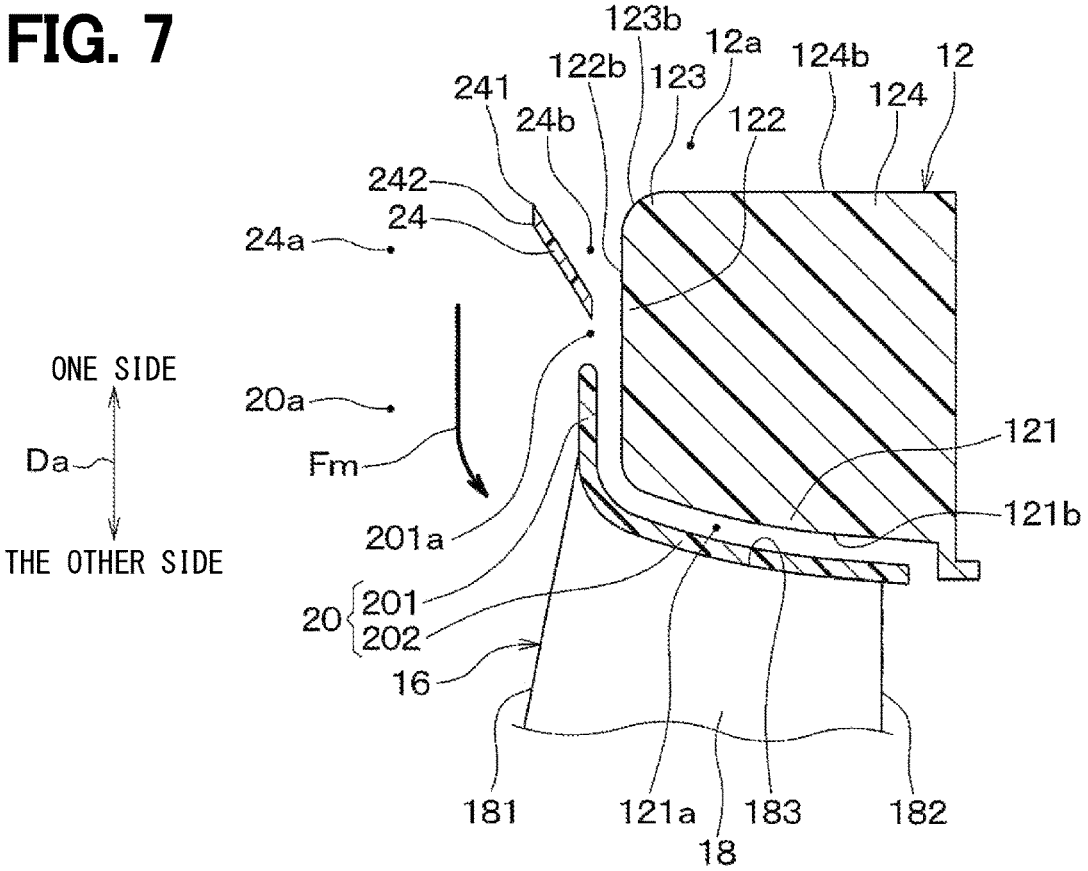
FIG. 7 is an enlarged cross-sectional view illustrating a portion corresponding to the IV portion in FIG. 2 in an enlarged manner in a fourth embodiment, and is a view corresponding to FIG. 4.

As illustrated in FIG. 7, in the present embodiment, the cross-sectional shape of the guide part 24 obtained by cutting along the plane including the fan axis CL is not an airfoil shape. The cross-sectional shape of the guide part 24 is a plate shape extending in the fan axial direction Da and inclined with respect to the fan axis CL. Specifically, the cross-sectional shape of the guide part 24 is a plate shape that is located more outside in the fan radial direction Dr as it is farther on the other side in the fan axial direction Da.

That is, the guide part 24 has a cylindrical shape extending in the fan axial direction Da, and is tapered to expand more in diameter as it is farther on the other side in the fan axial direction Da.

In the present embodiment, the entire guide part 24 is arranged on the one side in the fan axial direction Da with respect to the fan ring portion 201. Therefore, the guide part 24 does not have the overlapping portion 243 (see FIG. 4). The gap 201*a* between the fan ring portion 201 and the guide part 24 is located on the other side in the fan axial direction Da with respect to the guide part 24.

The present embodiment is similar to the first embodiment except for the above description. In the present embodiment, effects exhibited by components common to the above-described first embodiment can be obtained as in the first embodiment.

Fifth Embodiment

Next, a fifth embodiment will be described. In the present embodiment, differences from the above-described first embodiment will be mainly described.

Figure 8:
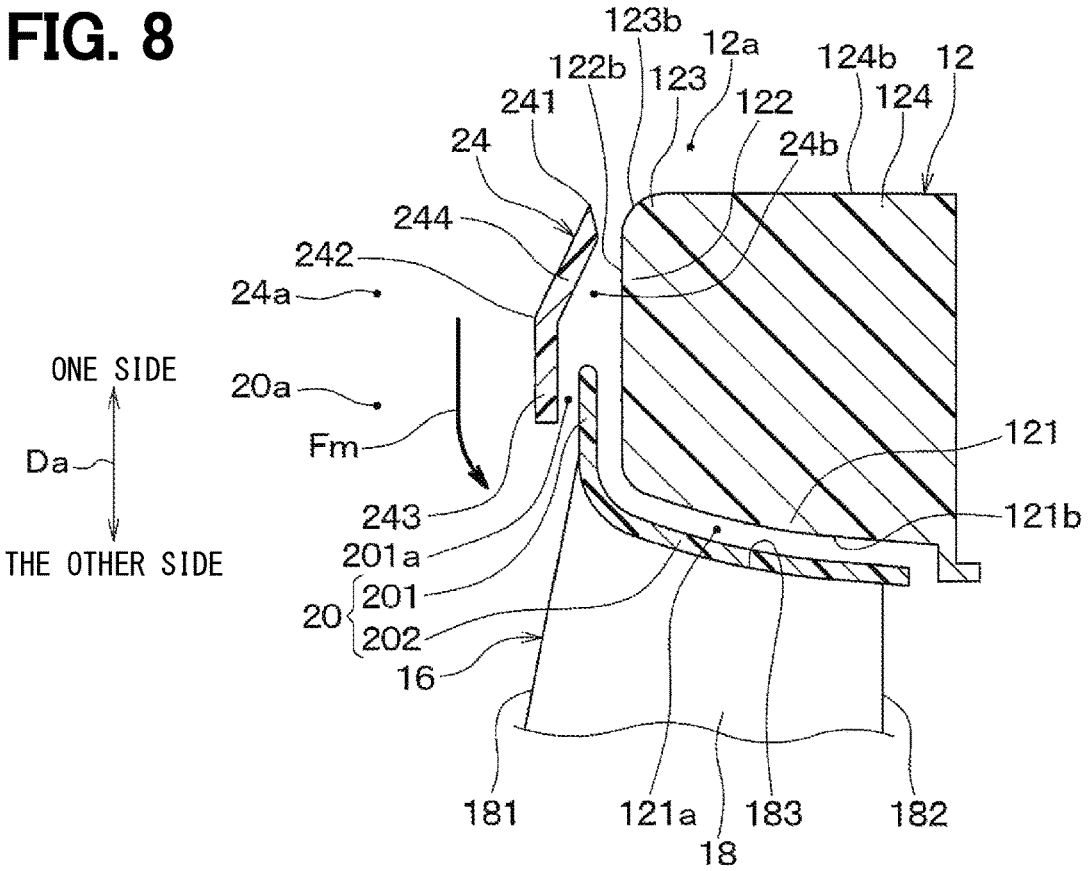
FIG. 8 is an enlarged cross-sectional view illustrating a portion corresponding to the IV portion in FIG. 2 in an enlarged manner in a fifth embodiment, and is a view corresponding to FIG. 4.

As illustrated in FIG. 8, in the present embodiment, the cross-sectional shape of the guide part 24 obtained by cutting along the plane including the fan axis CL is not an airfoil shape. The cross-sectional shape of the guide part 24 is a plate shape extending in the fan axial direction Da and partially inclined with respect to the fan axis CL. Specifically, the cross-sectional shape of the guide part 24 is a bent plate shape, and the cross-sectional shape of the overlapping portion 243 in the guide part 24 is a plate shape extending in the fan axial direction Da along the fan axis CL. That is, the overlapping portion 243 has a cylindrical shape extending along the fan axial direction Da.

A cross-sectional shape of an inclined portion, which is a portion constituting at least a part of the extension portion 244 and including the one end 241 of the guide part 24, is a plate shape that is located more outside in the fan radial direction Dr as it is farther on the one side in the fan axial direction Da. That is, the inclined portion included in the extension portion 244 has a tapered cylindrical shape that expands more in diameter as it is farther on the one side in the fan axial direction Da.

Due to such a shape of the guide part 24, in the present embodiment, the innermost peripheral portion 242 of the guide part 24 is located on the other side in the fan axial direction Da with respect to the inclined portion.

The present embodiment is similar to the first embodiment except for the above description. In the present embodiment, effects exhibited by components common to the above-described first embodiment can be obtained as in the first embodiment.

Sixth Embodiment

Next, a sixth embodiment will be described. In the present embodiment, differences from the above-described fifth embodiment will be mainly described.

Figure 9:
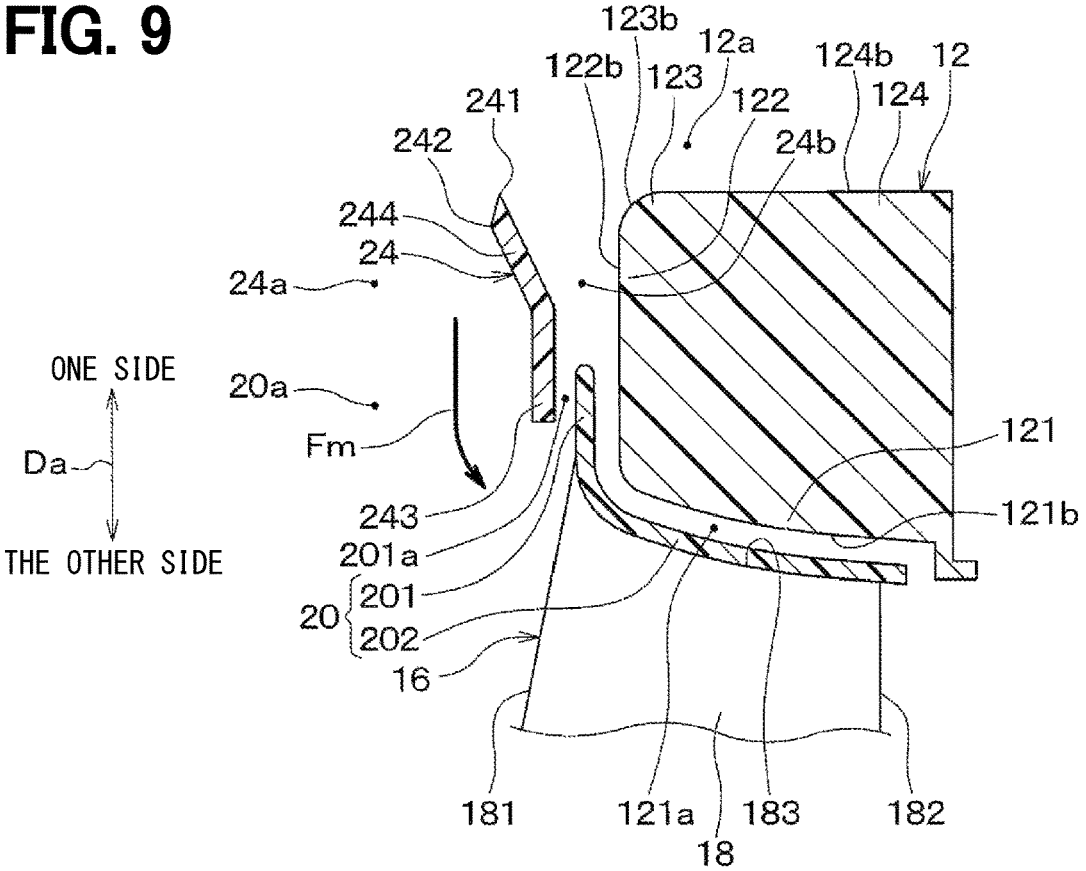
FIG. 9 is an enlarged cross-sectional view illustrating a portion corresponding to the IV portion in FIG. 2 in an enlarged manner in a sixth embodiment, and is a view corresponding to FIG. 4.

As illustrated in FIG. 9, in the present embodiment, the direction of the taper of the inclined portion included in the extension portion 244 is opposite to that of the fifth embodiment. That is, the inclined portion included in the extension portion 244 has a tapered cylindrical shape that decreases more in diameter as it is farther on the one side in the fan axial direction Da.

Due to such a shape of the guide part 24, in the present embodiment, the innermost peripheral portion 242 of the guide part 24 is included in the inclined portion in the extension portion 244.

The present embodiment is similar to the fifth embodiment except for the above description. In the present embodiment, effects exhibited by components common to the above-described fifth embodiment can be obtained as in the fifth embodiment.

Seventh Embodiment

Next, a seventh embodiment will be described. In the present embodiment, differences from the above-described second embodiment will be mainly described.

Figure 10:
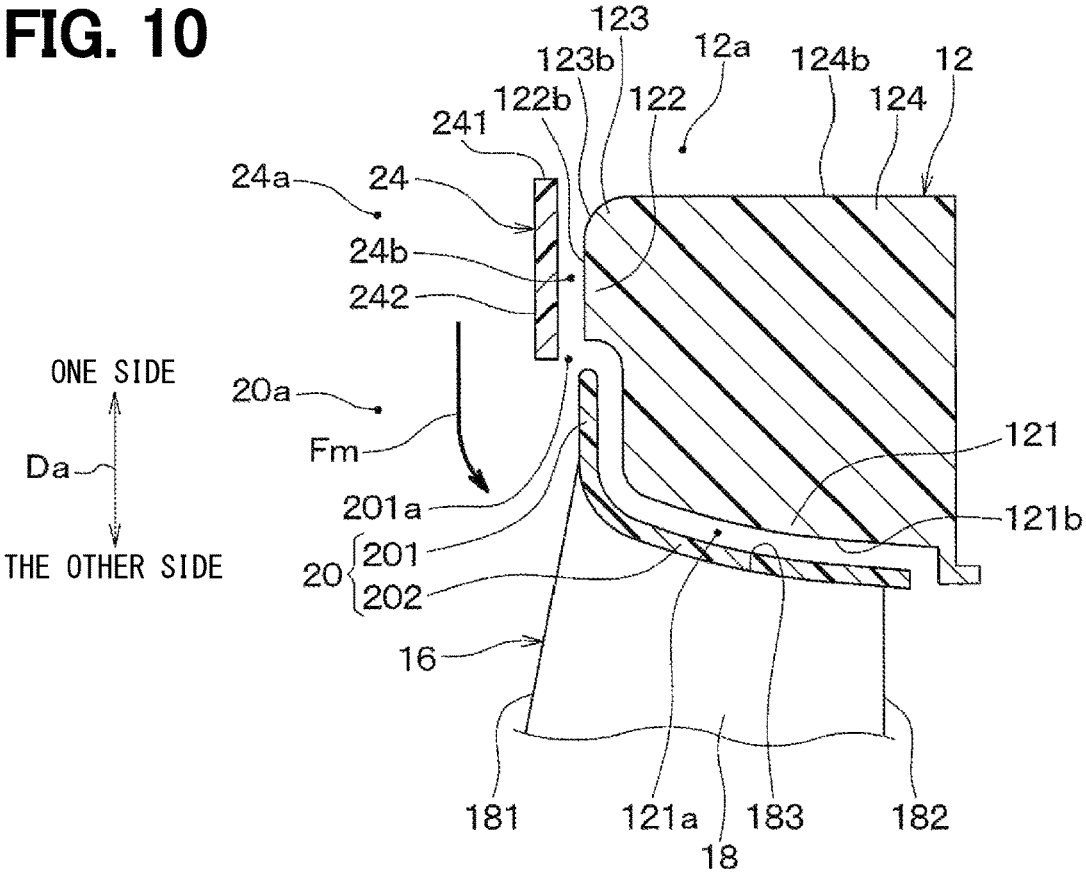
FIG. 10 is an enlarged cross-sectional view illustrating a portion corresponding to the IV portion in FIG. 2 in an enlarged manner in a seventh embodiment, and is a view corresponding to FIG. 4.

As illustrated in FIG. 10, in the present embodiment, the one end 241 of the guide part 24 is located on the one side in the fan axial direction Da with respect to the surface connecting portion 123*b* of the case 12. Therefore, as compared with a case where the positional relationship between the one end 241 of the guide part 24 and the surface connecting portion 123*b* is not as above, a part of air flowing toward the suction port 24*a* along the air guide surface 124*b* is easily guided to the communication path 24*b* by the guide part 24.

Such a positional relationship between the one end 241 of the guide part 24 and the surface connecting portion 123*b* of the case 12 is particularly effective when a device functioning as a rectifying body that rectifies an air flow, such as a heat exchanger or a filter, is provided on the air flow upstream side with respect to the blower 10.

Since the air guide surface 124*b* of the case 12 has a planar shape orthogonal to the fan axis CL, the one end 241 of the guide part 24 is located on the one side in the fan axial direction Da with respect to the air guide surface 124*b* of the case 12.

In the present embodiment, the entire guide part 24 is arranged on the one side in the fan axial direction Da with respect to the fan ring portion 201. Therefore, the guide part 24 does not have the overlapping portion 243 (see FIG. 5).

The present embodiment is similar to the second embodiment except for the above description. In the present embodiment, effects exhibited by components common to the above-described second embodiment can be obtained as in the second embodiment.

Although the present embodiment is a modification based on the second embodiment, the present embodiment can be combined with any of the above-described third to sixth embodiments.

Eighth Embodiment

Next, an eighth embodiment will be described. In the present embodiment, differences from the above-described seventh embodiment will be mainly described.

Figure 11:
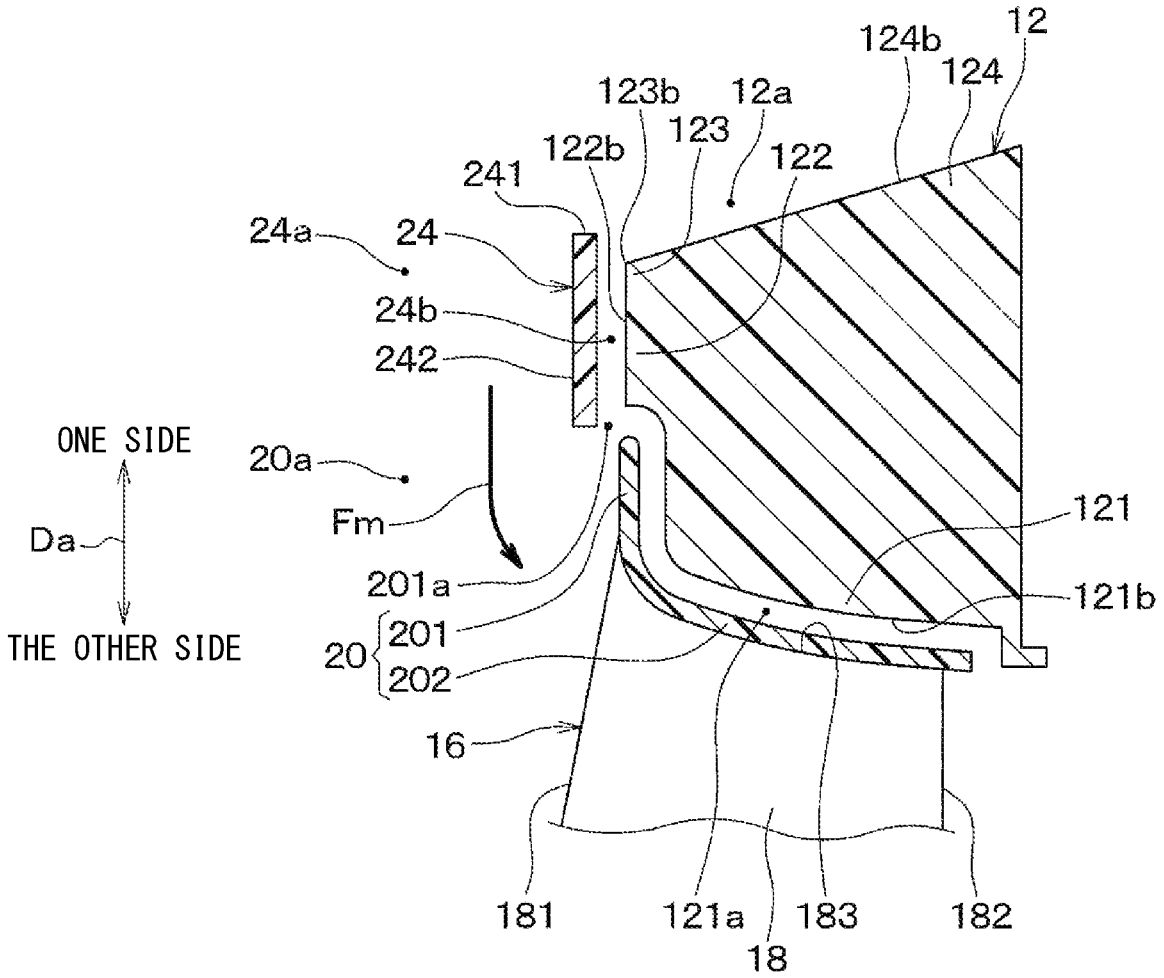
FIG. 11 is an enlarged cross-sectional view illustrating a portion corresponding to the IV portion in FIG. 2 in an enlarged manner in an eighth embodiment, and is a view corresponding to FIG. 4.

As illustrated in FIG. 11, in the present embodiment, the air guide surface 124*b* of the case 12 is a surface facing the one side in the fan axial direction Da, but is an inclined surface whose normal direction is slightly inclined with respect to the fan axial direction Da. Specifically, the air guide surface 124*b* is inclined with respect to the fan axis CL such that it is located farther on the one side in the fan axial direction Da as it is more outside in the fan radial direction Dr.

Therefore, in the present embodiment, it cannot be said that the one end 241 of the guide part 24 is located on the one side in the fan axial direction Da with respect to the air guide surface 124*b* of the case 12. However, as in the seventh embodiment, also in the present embodiment, the one end 241 of the guide part 24 is located on the one side in the fan axial direction Da with respect to the surface connecting portion 123*b* of the case 12.

In a longitudinal cross section (that is, a longitudinal cross section of FIG. 11) obtained by cutting the case 12 along a plane including the fan axis CL, a radius of curvature of the surface connecting portion 123*b* of the case 12 is zero or substantially zero. Therefore, the surface connecting portion 123*b* is not formed as a bell mouth surface. In the longitudinal cross section of FIG. 11, since the radius of curvature of the surface connecting portion 123*b* is zero or substantially zero, it can be said that the surface connecting portion 123*b* is provided as a portion where the radius of curvature in the longitudinal cross section is locally reduced with respect to the inward surface 122*b* and the air guide surface 124*b*.

The present embodiment is similar to the seventh embodiment except for the above description. In the present embodiment, effects exhibited by components common to the above-described seventh embodiment can be obtained as in the seventh embodiment.

Ninth Embodiment

Next, a ninth embodiment will be described. In the present embodiment, differences from the above-described first embodiment will be mainly described.

Figure 12:
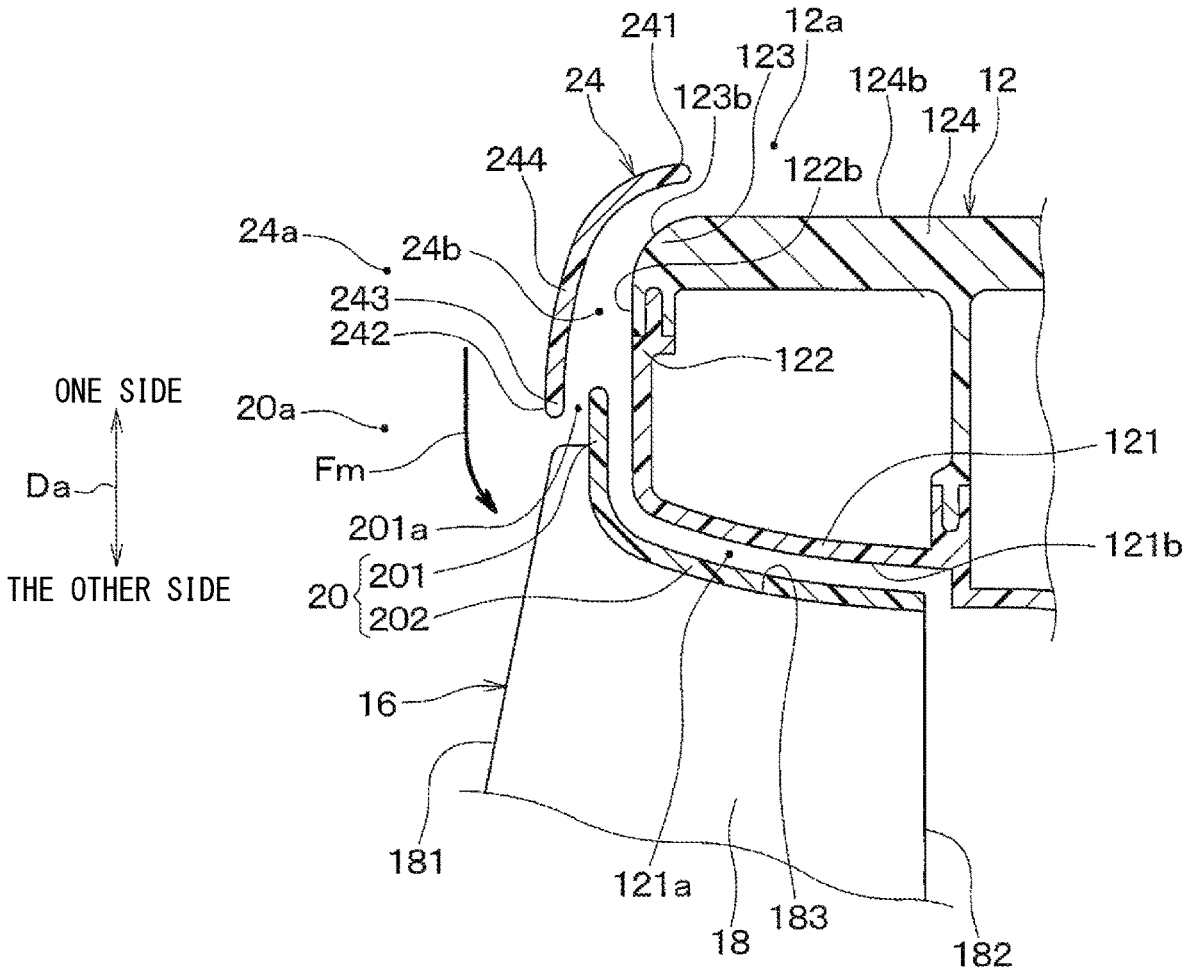
FIG. 12 is an enlarged cross-sectional view illustrating a portion corresponding to the IV portion in FIG. 2 in an enlarged manner in a ninth embodiment, and is a view corresponding to FIG. 4.

As illustrated in FIG. 12, in the present embodiment, the one end 241 of the guide part 24 is located on the one side in the fan axial direction Da with respect to the surface connecting portion 123*b* of the case 12. Since the air guide surface 124*b* of the case 12 has a planar shape orthogonal to the fan axis CL, the one end 241 of the guide part 24 is located on the one side in the fan axial direction Da with respect to the air guide surface 124*b* of the case 12.

In the present embodiment, the cross-sectional shape of the guide part 24 obtained by cutting along the plane including the fan axis CL is not an airfoil shape. The cross-sectional shape of the guide part 24 is a plate shape extending and curving in the fan axial direction Da.

Specifically, the guide part 24 has a tubular shape in which the one side in the fan axial direction Da is expanded. That is, the guide part 24 extends from the other side to the one side in the fan axial direction Da while bending so as to expand outward in the fan radial direction Dr. The cross-sectional shape of the guide part 24 obtained by cutting along the plane including the fan axis CL has a curved shape that decreases more in radius of curvature as it is farther on the one side in the fan axial direction Da. Thus, for example, as compared with a case where the one end 241 side of the guide part 24 is parallel to the fan axial direction Da, a part of the air flowing toward the suction port 24*a* along the air guide surface 124*b* of the case 12 can be smoothly guided to the communication path 24*b* by the guide part 24.

The present embodiment is similar to the first embodiment except for the above description. In the present embodiment, effects exhibited by components common to the above-described first embodiment can be obtained as in the first embodiment.

Tenth Embodiment

Next, a tenth embodiment will be described. In the present embodiment, differences from the above-described first embodiment will be mainly described.

Figure 13:
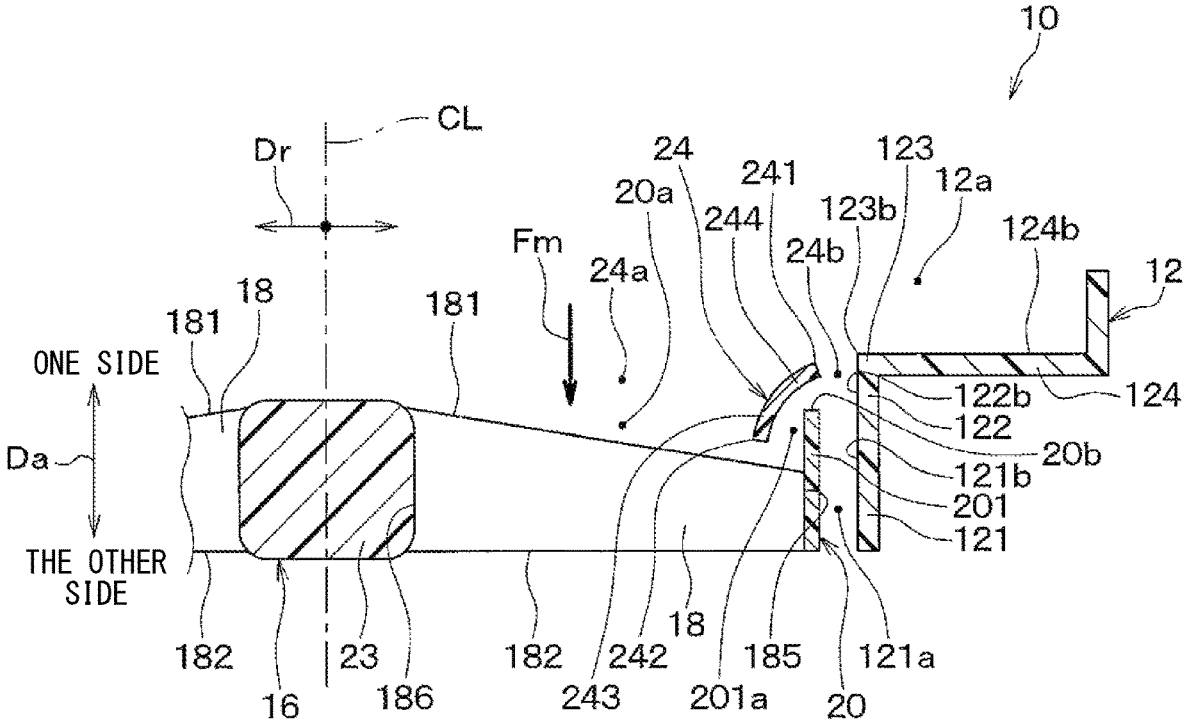
FIG. 13 is a cross-sectional view illustrating a longitudinal cross section obtained by cutting a blower along a virtual plane including a fan axis in a tenth embodiment.

As illustrated in FIG. 13, the blower 10 of the present embodiment is not a centrifugal blower but an axial blower. Therefore, the fan 16 of the present embodiment is an axial fan.

Thus, the fan 16 does not have the main plate 22 (see FIG. 2), but has a fan boss 23 instead. The fan boss 23 is fixed to the motor rotation shaft 142 (see FIG. 2). The blower 10 of the present embodiment has the electric motor 14 as in the first embodiment, but the electric motor 14 is not illustrated in FIG. 13. In FIG. 13, the left half of the blower 10 on the paper plane is not illustrated.

Each of the blades 18 of the fan 16 has one end 185 of the blade provided outside in the fan radial direction Dr and the other end 186 of the blade provided inside in the fan radial direction Dr. The one end 185 of the blade is connected to the side plate 20, and the other end 186 of the blade is connected to the fan boss 23.

Accordingly, the fan 16 rotates integrally with the motor rotation shaft 142 around the fan axis CL. The fan 16 rotates around the fan axis CL to suck air from the one side in the fan axial direction Da with respect to the fan ring portion 201 to between the blades 18 through the inside of the fan ring portion 201. At the same time, the fan 16 blows the air sucked to between the blades 18 to the other side in the fan axial direction Da.

In a longitudinal cross section (that is, a longitudinal cross section of FIG. 13) obtained by cutting the case 12 along a plane including the fan axis CL, the radius of curvature of the surface connecting portion 123*b* of the case 12 is zero or substantially zero. Therefore, the surface connecting portion 123*b* is not formed as a bell mouth surface. In the longitudinal cross section of FIG. 13, since the radius of curvature of the surface connecting portion 123*b* is zero or substantially zero, it can be said that the surface connecting portion 123*b* is provided as a portion where the radius of curvature in the longitudinal cross section is locally reduced with respect to the inward surface 122*b* and the air guide surface 124*b*.

As described above, since the fan 16 of the present embodiment is an axial fan, the side plate 20 has the fan ring portion 201 but does not have the downstream expanded diameter portion 202 (see FIG. 4). That is, the entire side plate 20 is formed of the fan ring portion 201.

For example, the fan ring portion 201 of the present embodiment has a cylindrical shape or a substantially cylindrical shape. The fan ring portion 201 has a portion projecting to the one side in the fan axial direction Da with respect to the position of the one end 185 of the blade. That is, the one end 20*b* of the side plate is provided on the one side in the fan axial direction Da with respect to the one end 185 of the blade connected to the side plate 20.

The cross-sectional shape of the guide part 24 obtained by cutting along the plane including the fan axis CL is not an airfoil shape. The cross-sectional shape of the guide part 24 is a plate shape extending in the fan axial direction Da and inclined with respect to the fan axis CL. Specifically, the cross-sectional shape of the guide part 24 is a plate shape that is located more outside in the fan radial direction Dr as it is farther on the one side in the fan axial direction Da. That is, the guide part 24 has a tubular shape in which the one side in the fan axial direction Da is expanded.

Also in the present embodiment, as in the first embodiment, a communication path 24*b* is formed outside the guide part 24 in the fan radial direction Dr. The communication path 24*b* allows the upstream space 12*a* to communicate with the gap 201*a* between the fan ring portion 201 and the guide part 24. The fan ring portion 201 of the side plate 20 is located outside in the fan radial direction Dr with respect to the innermost peripheral portion 242 of the guide part 24.

The present embodiment is similar to the first embodiment except for the above description. In the present embodiment, effects exhibited by components common to the above-described first embodiment can be obtained as in the first embodiment.

Although the present embodiment is a modification based on the first embodiment, the present embodiment can be combined with any of the above-described second to ninth embodiments.

Eleventh Embodiment

Next, an eleventh embodiment will be described. In the present embodiment, differences from the above-described first embodiment will be mainly described.

Figure 14:
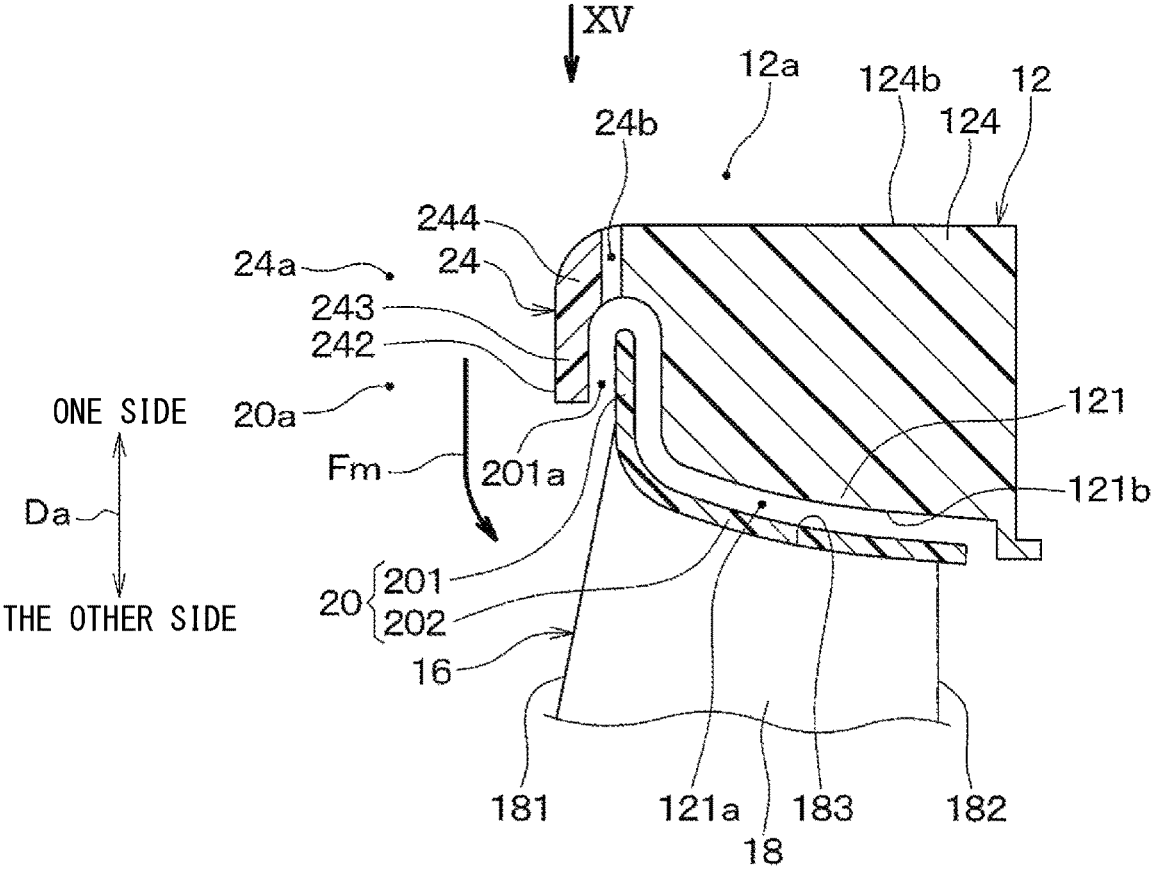
FIG. 14 is an enlarged cross-sectional view illustrating a portion corresponding to the IV portion in FIG. 2 in an enlarged manner in an eleventh embodiment, and is a view corresponding to FIG. 4.
Figure 15:
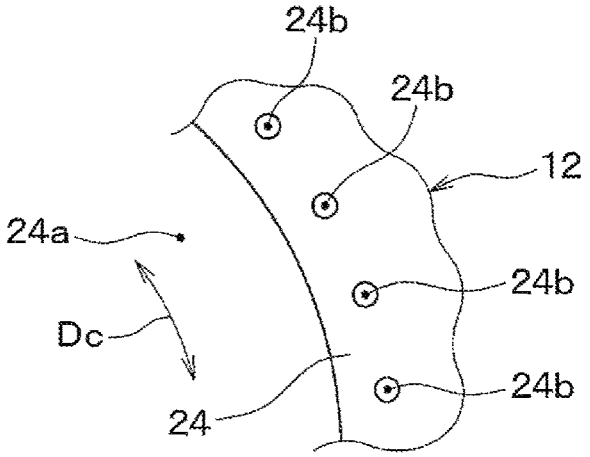
FIG. 15 is an arrow view in an XV direction in FIG. 14, and is a view illustrating a portion of a guide part and a periphery thereof as viewed in a direction from the one side to the other side in the fan axial direction.

As illustrated in FIGS. 14 and 15, in the present embodiment, the guide part 24 is configured as a portion of the case 12. For example, the guide part 24 has a shape continuous from the air guide portion 124.

Also in the present embodiment, as in the first embodiment, a communication path 24*b* is formed outside the guide part 24 in the fan radial direction Dr. However, the communication path 24*b* is provided as a plurality of through holes penetrating the case 12 in the fan axial direction Da. The plurality of communication paths 24*b* is arranged at predetermined intervals in the fan circumferential direction Dc, and is provided over the entire circumference around the fan axis CL.

The present embodiment is similar to the first embodiment except for the above description. In the present embodiment, effects exhibited by components common to the above-described first embodiment can be obtained as in the first embodiment.

Twelfth Embodiment

Next, a twelfth embodiment will be described. In the present embodiment, differences from the above-described first embodiment will be mainly described.

Figure 16:
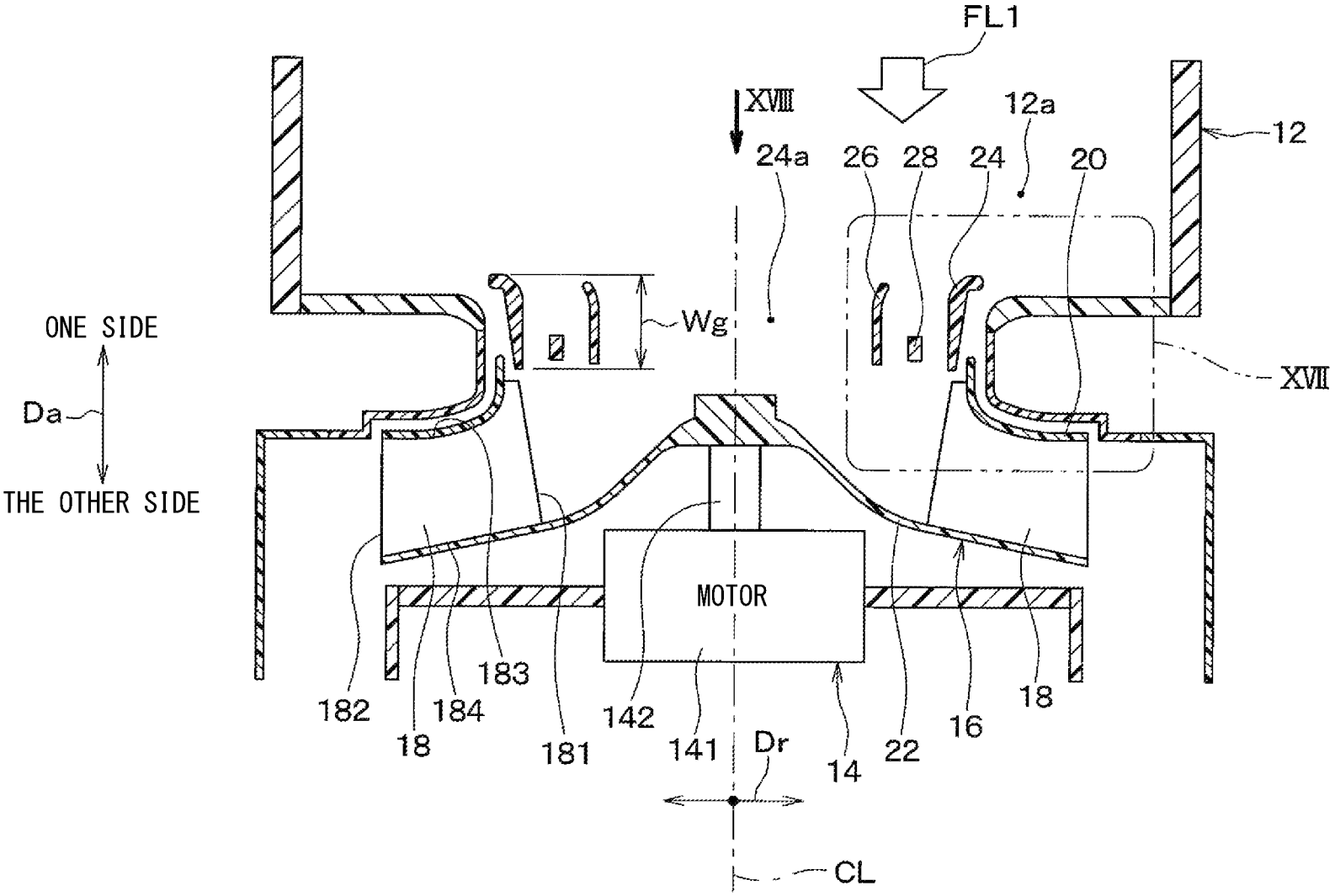
FIG. 16 is a cross-sectional view illustrating a longitudinal cross section obtained by cutting a blower along a virtual plane including a fan axis in a twelfth embodiment, and is a view corresponding to FIG. 2.
Figure 17:
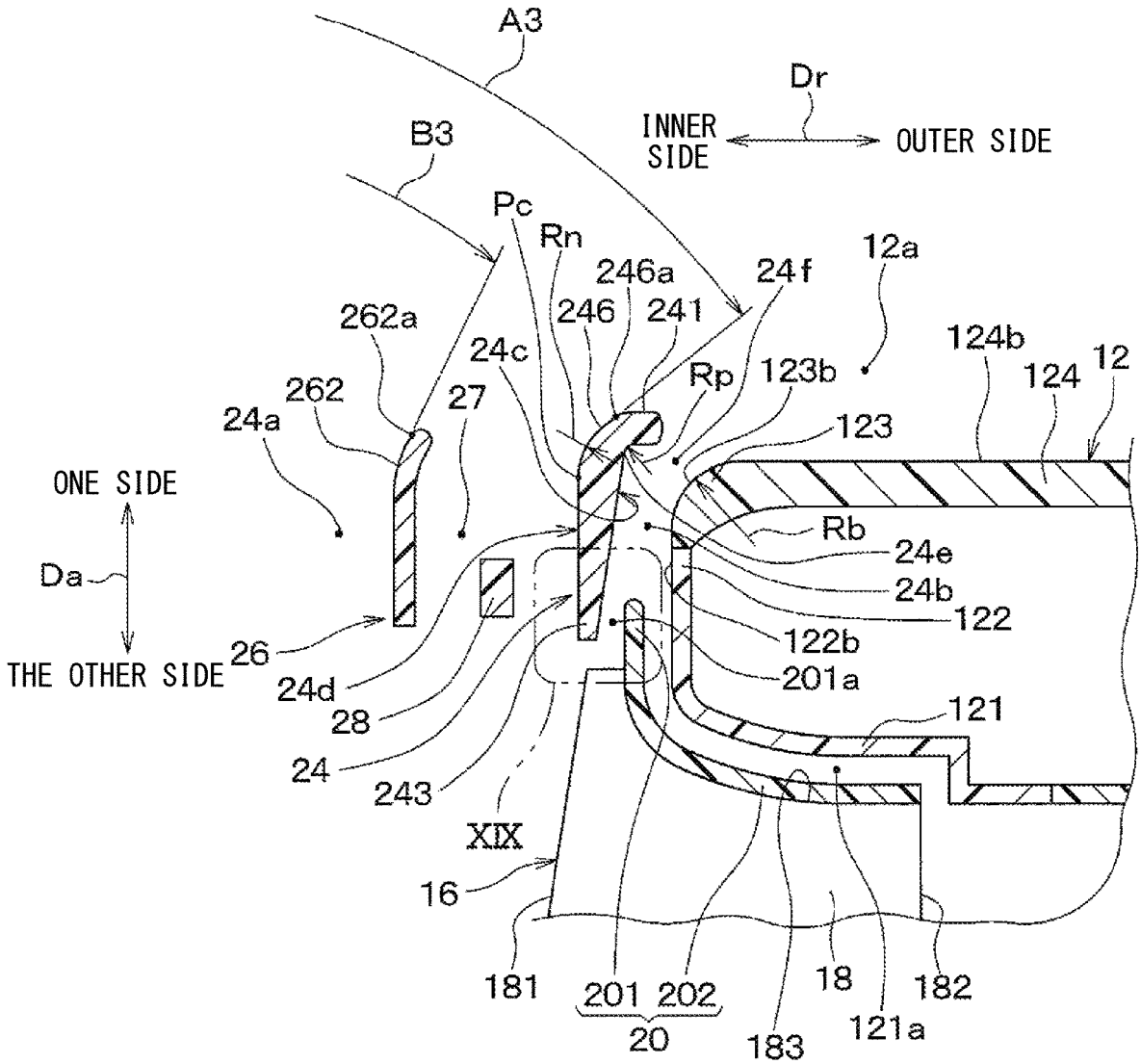
FIG. 17 is an enlarged cross-sectional view illustrating a XVII portion in FIG. 16 in an enlarged manner in the twelfth embodiment, and is a view corresponding to FIG. 4.

As illustrated in FIGS. 16 and 17, in the present embodiment, the blower 10 includes an inner annular part 26 that is annular and formed around the fan axis CL in addition to the guide part 24. Since the inner annular part 26 forms an annular shape concentric with the guide part 24, the guide part 24 may be referred to as an outer guide part, and the inner annular part 26 may be referred to as an inner guide part. As is the fan 16 of the first embodiment, the fan 16 of the present embodiment is also a turbo fan that rotates around the fan axis CL.

Specifically, the inner annular part 26 is arranged inside in the fan radial direction Dr with respect to the guide part 24 and is separated in the fan radial direction Dr from the guide part 24. Therefore, the inner annular part 26 forms a guide inner flow path 27, which penetrates in the fan axial direction Da and through which air flows, with the guide part 24. The guide inner flow path 27 is provided over the entire circumference around the inner annular part 26.

The inner annular part 26 has a shape in which the one side in the fan axial direction Da expands in diameter with respect to the other side.

The length of the inner annular part 26 in the fan axial direction Da is shorter than the length of the guide part 24 in the fan axial direction Da. In the fan axial direction Da, the inner annular part 26 is arranged to fall within a range Wg occupied by the guide part 24 in the fan axial direction Da.

The inner annular part 26 has a tapered annular portion inner surface 262 on the one side in the fan axial direction Da in the inner annular part 26. The tapered annular portion inner surface 262 faces inward in the fan radial direction Dr and is tapered to expand more outward in the fan radial direction Dr as it is farther on the one side in the fan axial direction Da. The tapered annular portion inner surface 262 may be a linear surface or a curved surface that is curved to some extent in the cross section of FIG. 17.

Similarly, the guide part 24 has a tapered guide inner surface 246 on the one side in the fan axial direction Da in the guide part 24. The tapered guide inner surface 246 faces inward in the fan radial direction Dr and is tapered to expand more outward in the fan radial direction Dr as it is farther on the one side in the fan axial direction Da. The tapered guide inner surface 246 may be a linear surface or a curved surface that is curved to some extent in the cross section of FIG. 17.

The tapered guide inner surface 246 has a tapered shape opened in the fan radial direction Dr toward the one side in the fan axial direction Da more than the tapered annular portion inner surface 262. That is, a taper angle A3 of the tapered guide inner surface 246 is larger than a taper angle B3 of the tapered annular portion inner surface 262. Specifically, the taper angle A3 of the tapered guide inner surface 246 is a taper angle of the tapered guide inner surface 246 at an end 246*a* on the one side in the fan axial direction Da in the tapered guide inner surface 246. Specifically, the taper angle B3 of the tapered annular portion inner surface 262 is a taper angle of the tapered annular portion inner surface 262 at an end 262*a* on the one side in the fan axial direction Da in the tapered annular portion inner surface 262. The tapered guide inner surface 246 and the tapered annular portion inner surface 262 do not include a surface of a corner R that connects the surfaces and locally has a small radius of curvature.

Figure 18:
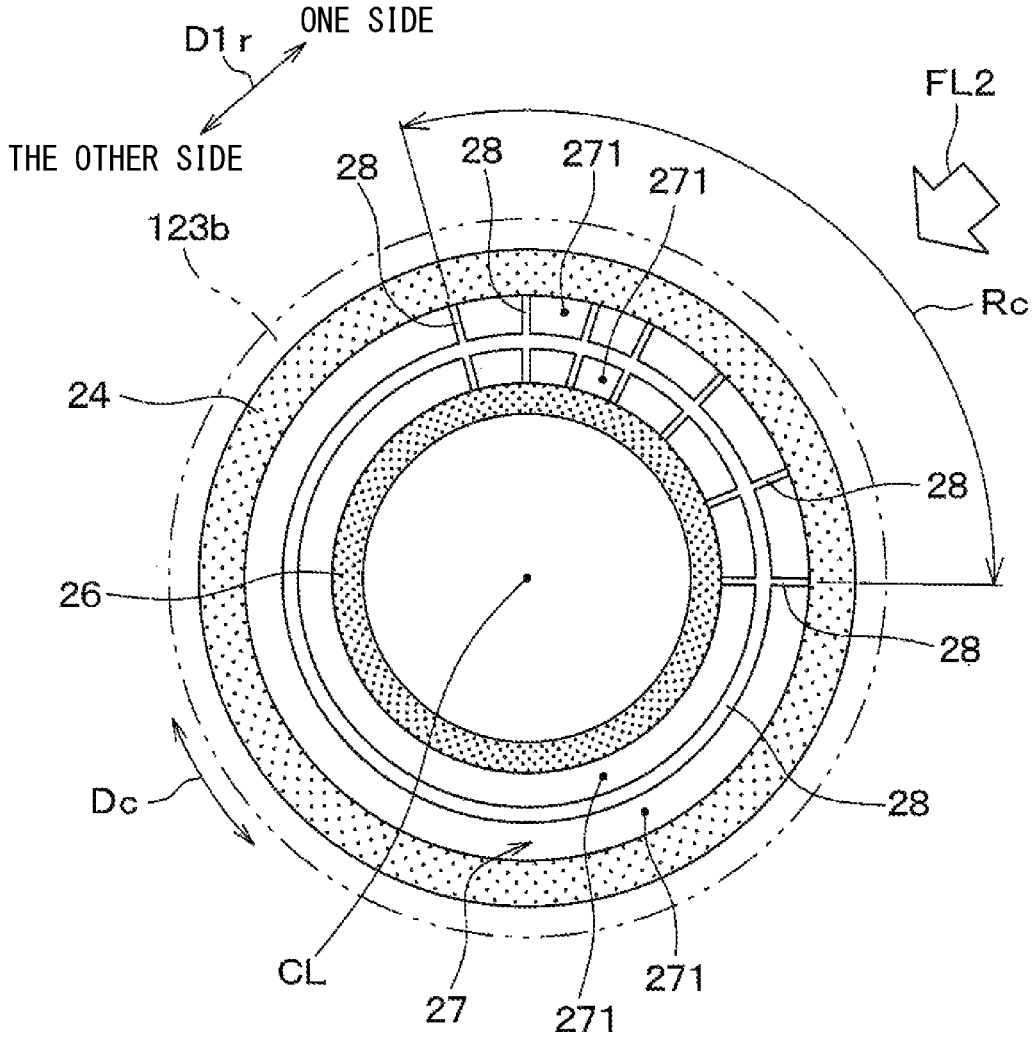
FIG. 18 is an arrow view in a XVIII direction in FIG. 16 in the twelfth embodiment, and is a view illustrating the guide part and a periphery thereof as viewed in a direction from the one side to the other side in the fan axial direction.

As illustrated in FIGS. 16 to 18, the blower 10 includes a partition 28 provided between the guide part 24 and the inner annular part 26. The partition 28 partitions the guide inner flow path 27 into a plurality of divided flow paths 271. The partition 28 includes, for example, a plurality of thin plate-shaped ribs whose thickness direction is a direction perpendicular to the fan axial direction Da. The partition 28 connects the guide part 24 and the inner annular part 26 to each other. In FIG. 18, dotted hatching is applied to each of the guide part 24 and the inner annular part 26 for easy viewing. In FIG. 18, the surface connecting portion 123*b* is indicated by a two-dot chain line.

In the present embodiment, unlike the first embodiment, on the air flow upstream side with respect to the suction port 24*a*, a flow rate distribution of air flowing to the suction port 24*a* is biased to one side in an uneven distribution direction D1*r*, which is one direction of the fan radial direction Dr, with respect to the fan axis CL. For example, when a filter or a heat exchanger provided on the one side in the fan axial direction Da with respect to the suction port 24*a* is arranged to be shifted to one side in the uneven distribution direction D1*r* with respect to the fan axis CL, such a deviation occurs in the flow rate distribution of the air.

Therefore, in the present embodiment, as indicated by an arrow FL1 in FIG. 16 and an arrow FL2 in FIG. 18, the main flow of an air flow toward the suction port 24*a* is directed toward the suction port 24*a* from a position shifted to the one side in the uneven distribution direction D1*r* with respect to the fan axis CL.

On the other hand, the partition 28 more finely divides the guide inner flow path 27 on the one side in the uneven distribution direction D1*r* with respect to the fan axis CL as compared with the other side opposite to the one side.

Also in the present embodiment, as in the first embodiment, the cross-sectional shape of the guide part 24 illustrated in the longitudinal cross section of FIG. 17, in other words, the cross-sectional shape of the guide part 24 obtained by cutting along the plane including the fan axis CL is an airfoil shape having the positive pressure surface 24*c* and the negative pressure surface 24*d* and extending in the fan axial direction Da. That is, the guide part 24 has the positive pressure surface 24*c* as a guide outer peripheral surface provided outside in the fan radial direction Dr. The guide part 24 has the negative pressure surface 24*d* as a guide inner peripheral surface provided inside in the fan radial direction Dr. The negative pressure surface 24*d* includes the tapered guide inner surface 246 described above.

Each of the positive pressure surface 24*c* and the negative pressure surface 24*d* of the guide part 24 has a shape in which the one side in the fan axial direction Da is curved so as to expand outward in the fan radial direction Dr in the longitudinal cross section of FIG. 17 that is a cross section including the fan axis CL. In the longitudinal cross section of FIG. 17, a minimum value Rn of the radius of curvature of the negative pressure surface 24*d* is larger a minimum value Rp of the radius of curvature of the positive pressure surface 24*c*.

When the positive pressure surface 24*c* of the guide part 24 is compared with the surface connecting portion 123*b*, the positive pressure surface 24*c* has a facing portion 24*e* facing the surface connecting portion 123*b* as a bell mouth surface. In the longitudinal cross section of FIG. 17, the facing portion 24*e* includes a portion having a radius of curvature (specifically, a portion having a radius of curvature Rp) smaller than a minimum value Rb of the radius of curvature of the surface connecting portion 123*b*. That is, the minimum value Rb of the radius of curvature of the surface connecting portion 123*b* and the minimum value Rp of the radius of curvature of the positive pressure surface 24*c* have a relationship of "Rb>Rp".

The negative pressure surface 24*d* of the guide part 24 is formed so as to decrease more in diameter from an end on one side toward the other side of the negative pressure surface 24*d* in the fan axial direction Da and to have a minimum diameter in the middle of reaching an end on the other side. The negative pressure surface 24*d* of the present embodiment has the minimum diameter at an intermediate position Pc in FIG. 17, and keeps having the minimum diameter until the end on the other side of the negative pressure surface 24*d* on the other side in the fan axial direction Da with respect to the intermediate position Pc.

When the entire negative pressure surface 24*d* of the guide part 24 is viewed in the longitudinal cross section of FIG. 17, the negative pressure surface 24*d* is formed such that the radius of curvature of the negative pressure surface 24*d* decreases more as it is farther on the one side in the fan axial direction Da.

Figure 19:
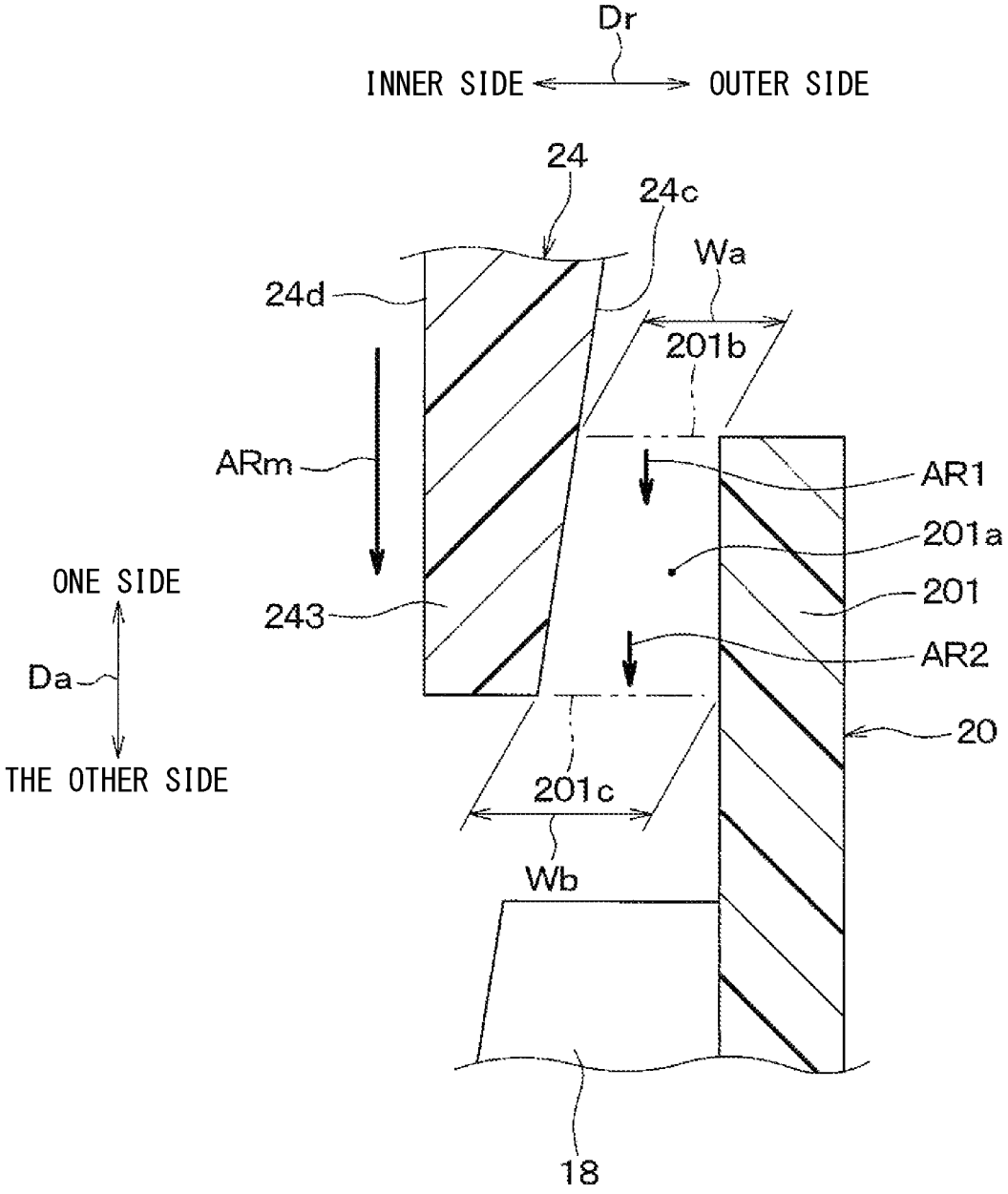
FIG. 19 is an enlarged cross-sectional view illustrating a XIX portion in FIG. 17 in an enlarged manner in the twelfth embodiment.

As illustrated in FIG. 19, the gap 201*a* between the fan ring portion 201 and the guide part 24 is formed so as to widen more as it is farther on the other side in the fan axial direction Da in the longitudinal cross section. In other words, the gap 201*a* has one end 201*b* on the one side in the fan axial direction Da and has the other end 201*c* on the other side in the fan axial direction Da. One end width Wa that the one end 201*b* of the gap 201*a* has in the fan radial direction Dr is smaller than the other end width Wb that the other end 201*c* of the gap 201*a* has in the fan radial direction Dr.

As illustrated in FIGS. 16 and 17, one end 241 of the guide part 24 is located on the one side in the fan axial direction Da with respect to the surface connecting portion 123*b* of the case 12. Since the air guide surface 124*b* of the case 12 has a planar shape orthogonal to the fan axis CL, the one end 241 of the guide part 24 is located on the one side in the fan axial direction Da with respect to the air guide surface 124*b* of the case 12. The communication path 24*b* has an upstream end 24*f* connected to the upstream space 12*a*. The communication path 24*b* is formed with a path cross-sectional area that is minimum at the upstream end 24*f* in the communication path 24*b*. In other words, the communication path 24*b* is formed as a narrowest path at the upstream end 24*f* in the communication path 24*b*.

In the present embodiment, the portion including the surface connecting portion 123*b* and the guide part 24 in the case 12 may be integrally molded, or may be molded as separate molded parts.

As described above, according to the present embodiment, as illustrated in FIGS. 16 and 17, the blower 10 includes the inner annular part 26 that is annular and arranged inside in the fan radial direction Dr with respect to the guide part 24. The inner annular part 26 forms the guide inner flow path 27, which penetrates in the fan axial direction Da and through which air flows, with the guide part 24. Therefore, since flow resistance of air in the guide inner flow path 27 increases as compared with the case where the inner annular part 26 is not provided, concentration of the air flow in the suction port 24*a* on the negative pressure surface 24*d* of the guide part 24 is suppressed. Thus, it is possible to reduce separation of the air flow generated on the negative pressure surface 24*d* of the guide part 24, and thus it is possible to suppress worsening of noise of the blower 10.

According to the present embodiment, the inner annular part 26 has a shape in which the one side in the fan axial direction Da expands in diameter with respect to the other side. Therefore, conversely, for example, as compared with a case where the other side in the fan axial direction Da of the inner annular part 26 expands in diameter with respect to the one side, the air flow flowing into a radially inside of the inner annular part 26 can be suppressed from separating from the surface of the inner annular part 26. According to the present embodiment, the inner annular part 26 has the tapered annular portion inner surface 262 on the one side in the fan axial direction Da in the inner annular part 26, and the guide part 24 has the tapered guide inner surface 246 on the one side in the fan axial direction Da in the guide part 24. The taper angle A3 of the tapered guide inner surface 246 is larger than the taper angle B3 of the tapered annular portion inner surface 262. Therefore, the air flow along the tapered guide inner surface 246 can be restricted to some extent by the inner annular part 26, so that it is possible to suppress separation of the air flow from the negative pressure surface 24*d* of the guide part 24 on or near the tapered guide inner surface 246.

According to the present embodiment, as illustrated in FIGS. 17 and 18, the partition 28 is provided between the guide part 24 and the inner annular part 26, and partitions the guide inner flow path 27 into the plurality of divided flow paths 271.

On the air flow upstream side with respect to the suction port 24*a*, the flow rate distribution of air flowing to the suction port 24*a* is biased to one side in the uneven distribution direction D1*r*, which is one direction of the fan radial directions Dr, with respect to the fan axis CL. On the other hand, the partition 28 more finely divides the guide inner flow path 27 on the one side in the uneven distribution direction D1*r* with respect to the fan axis CL as compared with the other side opposite to the one side.

In other words, in the flow rate distribution of the air flowing to the suction port 24*a* on the air flow upstream side of the suction port 24*a*, the flow rate of air flowing to the suction port 24*a* is larger in a certain circumferential range Rc (see FIG. 18) in the fan circumferential direction Dc than in the vicinity of the certain circumferential range Rc. On the other hand, the partition 28 divides the guide inner flow path 27 more finely in the certain circumferential range Rc in the fan circumferential direction Dc than in the vicinity of the certain circumferential range Rc.

Thus, the partition 28 can provide a difference in the flow resistance of air in the guide inner flow path 27 in the fan circumferential direction Dc. Therefore, as compared with the case where the partition 28 is not provided, unevenness of the flow rate distribution of air on the air flow upstream side with respect to the suction port 24*a* is reduced in the guide inner flow path 27. Consequently, flow velocity unevenness generated in the fan circumferential direction Dc in a flow velocity distribution of air flowing through the guide inner flow path 27 is reduced, and it is possible to suppress worsening of noise of the blower 10. Specifically, the magnitude of the air flow rate in the air flow rate distribution is the magnitude of the air flow rate per unit space (in other words, per unit region).

According to the present embodiment, FIG. 17 illustrates a longitudinal cross section including the fan axis CL. The positive pressure surface 24*c* as the guide outer peripheral surface and the negative pressure surface 24*d* as the guide inner peripheral surface of the guide part 24 each have a shape in which the one side in the fan axial direction Da is curved so as to expand outward in the fan radial direction Dr in the longitudinal cross section of FIG. 17. In the longitudinal cross section of FIG. 17, the minimum value Rn of the radius of curvature of the negative pressure surface 24*d* is larger the minimum value Rp of the radius of curvature of the positive pressure surface 24*c*. Therefore, for example, as compared with the case of "Rn=Rp", the air flow along the negative pressure surface 24*d* is gently bent, so that it is possible to suppress separation of the air flow from the negative pressure surface 24*d*.

According to the present embodiment, as illustrated in FIG. 17, the positive pressure surface 24*c* of the guide part 24 has the facing portion 24*e* facing the surface connecting portion 123*b* as the bell mouth surface. In the longitudinal cross section of FIG. 17, the facing portion 24*e* includes a portion having a radius of curvature (specifically, a portion having the radius of curvature Rp) smaller than the minimum value Rb of the radius of curvature of the surface connecting portion 123*b*.

Figure 20:
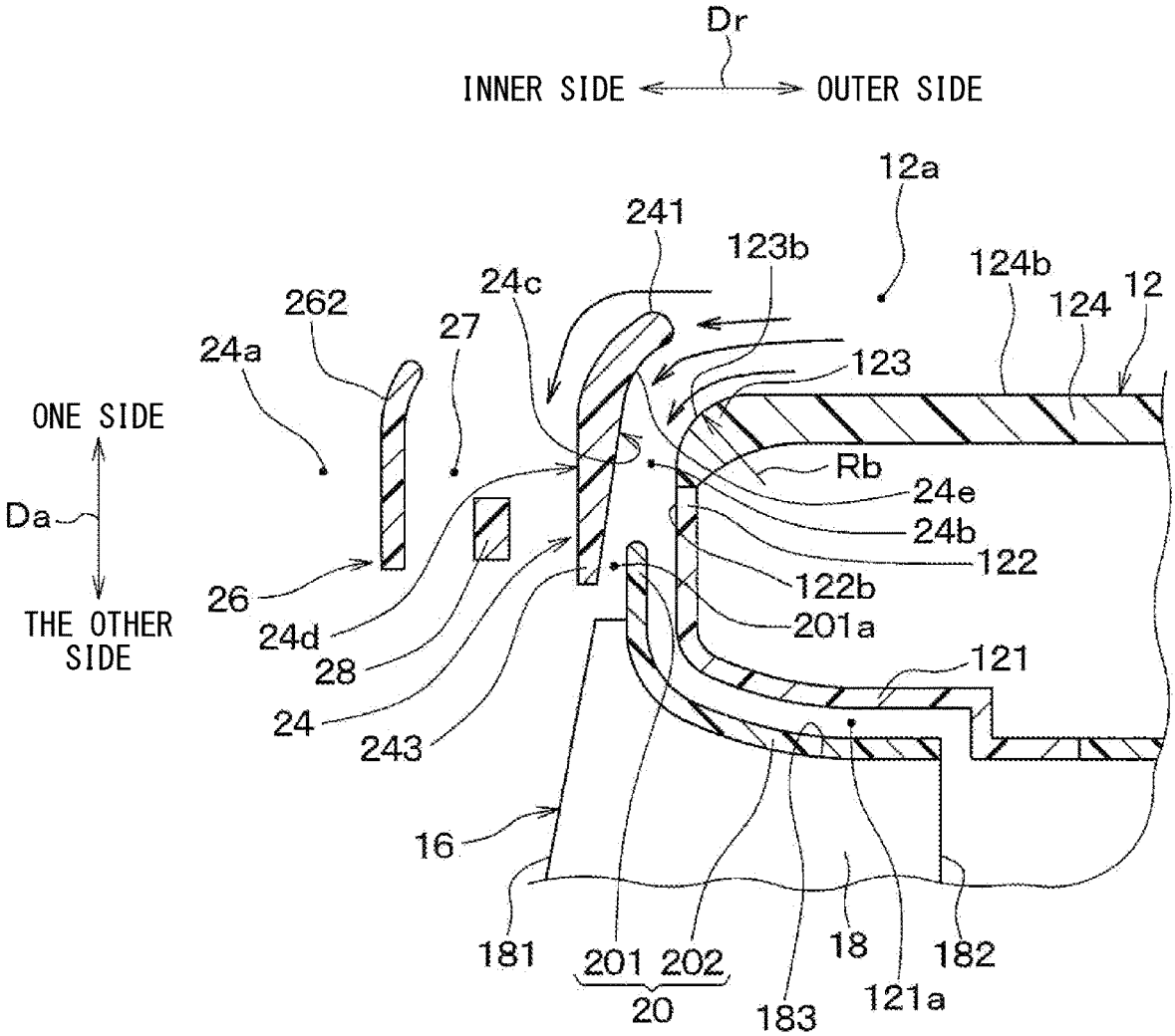
FIG. 20 is an enlarged sectional view illustrating a portion corresponding to the XVII portion in FIG. 16 in an enlarged manner in a comparative example used to describe an effect in the twelfth embodiment, and is a view corresponding to FIG. 17.

Therefore, for example, as compared with a case where, as illustrated in FIG. 20, the facing portion 24*e* is not as above, it is possible to reduce the flow velocity of air along the facing portion 24*e* between the facing portion 24*e* and the surface connecting portion 123*b*. When the flow velocity of air decreases, the flow velocity of air in the communication path 24*b* also decreases, so that the static pressure of air in the communication path 24*b* can be increased accordingly. When the static pressure of air in the communication path 24*b* increases in this manner, the static pressure difference between the vicinity of the blade trailing edge 182 and the communication path 24*b* decreases, and it is possible to reduce the air flow rate of the backflow air flow flowing backward through the gap 121*a* between the side plate 20 and the side plate facing portion 121.

Further, according to the present embodiment, as illustrated in FIG. 17, the negative pressure surface 24*d* of the guide part 24 is formed so as to decrease more in diameter from the end on one side toward the other side of the negative pressure surface 24*d* in the fan axial direction Da and to have the minimum diameter in the middle of reaching the end on the other side. Therefore, it is possible to cause the air flowing into the suction port 24*a* having the speed component directed radially inward to be directed in the direction along the fan axial direction Da while smoothly correcting the flow direction of air along the negative pressure surface 24*d*.

According to the present embodiment, as illustrated in FIGS. 17 and 19, the gap 201*a* between the fan ring portion 201 and the guide part 24 is formed so as to widen more as it is farther on the other side in the fan axial direction Da. Therefore, it is possible to lower the flow velocity of air flowing out from the other end 201*c* of the gap 201*a* as indicated by an arrow AR2 with respect to the flow velocity of air passing through the one end 201*b* of the gap 201*a* as indicated by an arrow AR1. Thus, when the air flowing out from the other end 201*c* of the gap 201*a* and air flowing along the negative pressure surface 24*d* of the guide part 24 as indicated by an arrow ARm merge, the flow velocity difference of the air is reduced, so that it is possible to reduce turbulence of air flow.

According to the present embodiment, as illustrated in FIG. 17, the one end 241 of the guide part 24 is located on the one side in the fan axial direction Da with respect to the surface connecting portion 123*b* of the case 12. Therefore, as compared with a case where the positional relationship between the one end 241 of the guide part 24 and the surface connecting portion 123*b* is not as above, a part of air flowing toward the suction port 24*a* along the air guide surface 124*b* is easily guided to the communication path 24*b* by the guide part 24.

According to the present embodiment, the communication path 24*b* has the upstream end 24*f* connected to the upstream space 12*a*. The communication path 24*b* is formed with a path cross-sectional area that is minimum at the upstream end 24*f* in the communication path 24*b*.

Therefore, for example, as compared with a case where the path cross-sectional area of the communication path 24*b* is uniform, the flow velocity of air can be reduced on the air flow downstream side with respect to the upstream end 24*f* in the communication path 24*b*. As the flow velocity of air decreases, it is possible to increase the static pressure of air at the position of merging with the backflow air flow in the communication path 24*b*. When the static pressure of air in the communication path 24*b* increases in this manner, the static pressure difference between the vicinity of the blade trailing edge 182 and the communication path 24*b* decreases, and the air flow rate of the backflow air flow can be reduced.

The present embodiment is similar to the first embodiment except for the above description. In the present embodiment, effects exhibited by components common to the above-described first embodiment can be obtained as in the first embodiment.

Thirteenth Embodiment

Next, a thirteenth embodiment will be described. In the present embodiment, differences from the above-described twelfth embodiment will be mainly described.

Figure 21:
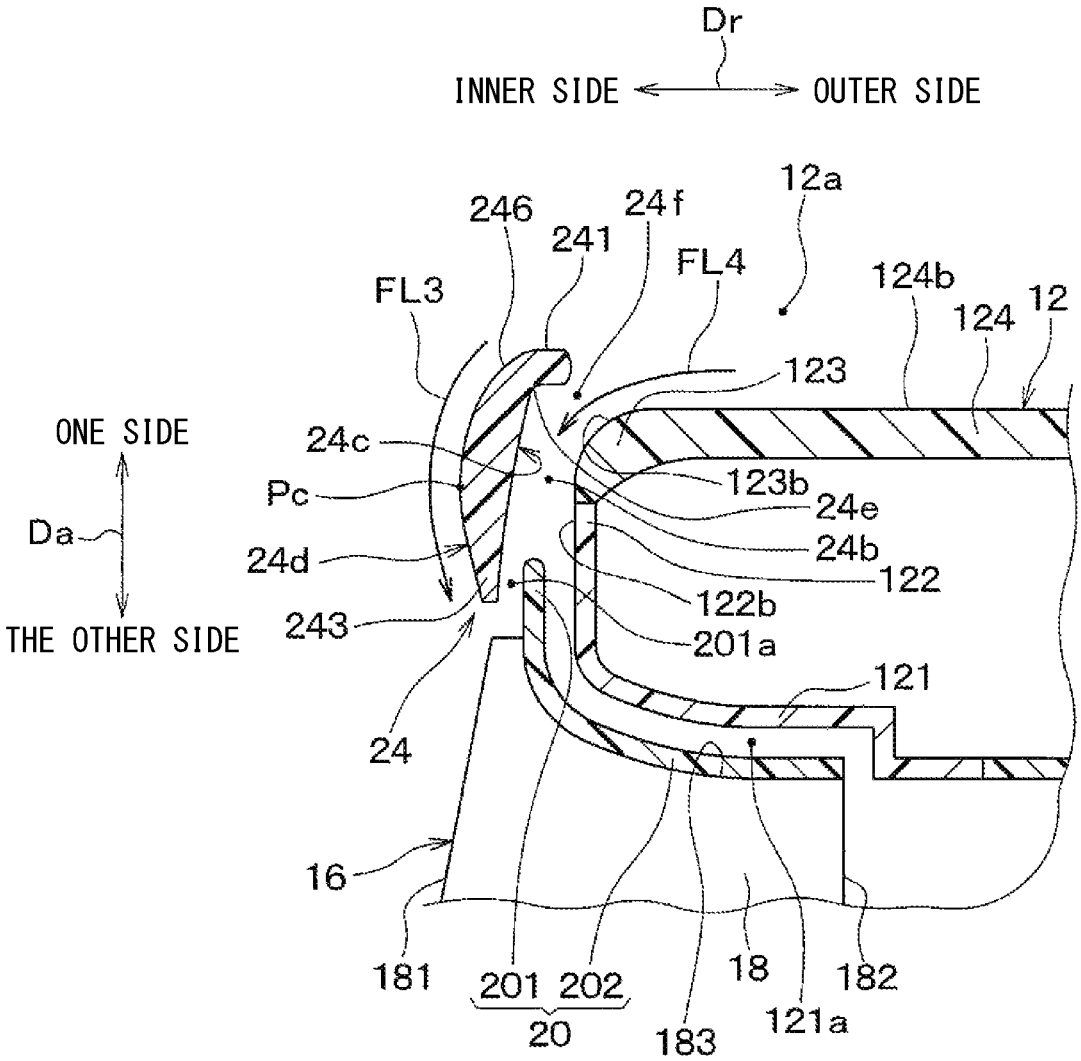
FIG. 21 is an enlarged cross-sectional view illustrating a portion corresponding to the XVII portion in FIG. 16 in an enlarged manner in a thirteenth embodiment, and is a view corresponding to FIG. 17.

As illustrated in FIG. 21, also in the present embodiment, as in the twelfth embodiment, the negative pressure surface 24*d* of the guide part 24 is formed to decrease more in diameter from an end on the one side toward the other side of the negative pressure surface 24*d* in the fan axial direction Da and to have the minimum diameter in the middle of reaching the end on the other side. The negative pressure surface 24*d* of the present embodiment has the minimum diameter at an intermediate position Pc in FIG. 21.

However, unlike the twelfth embodiment, the negative pressure surface 24*d* of the present embodiment expands more in diameter as it is farther on the other side in the fan axial direction Da on the other side in the fan axial direction Da with respect to the intermediate position Pc. A diameter of the negative pressure surface 24*d* at an end on the one side in the fan axial direction Da is larger than a diameter at an end on the other side in the fan axial direction Da. As described above, the negative pressure surface 24*d* of the present embodiment is a curved surface bulging inward in the fan radial direction Dr with the intermediate position Pc in FIG. 21 as a vertex position.

Therefore, since a speed component directed outward in the fan radial direction Dr as indicated by an arrow FL3 can be given to the air flow along the negative pressure surface 24*d* of the guide part 24, it becomes easy to pour the air flow passing through the suction port 24*a* to between the blades 18.

Although the blower 10 also includes the inner annular part 26 and the partition 28 in the present embodiment, the inner annular part 26 and the partition 28 are not illustrated in FIG. 21. The arrow FL3 in FIG. 21 indicates an air flow along the negative pressure surface 24*d* of the guide part 24, and an arrow FL4 indicates an air flow flowing from the upstream space 12*a* into the communication path 24*b*.

The present embodiment is similar to the twelfth embodiment except for the above description. In the present embodiment, effects exhibited by components common to the above-described twelfth embodiment can be obtained as in the twelfth embodiment.

Fourteenth Embodiment

Next, a fourteenth embodiment will be described. In the present embodiment, differences from the above-described twelfth embodiment will be mainly described.

Figure 22:
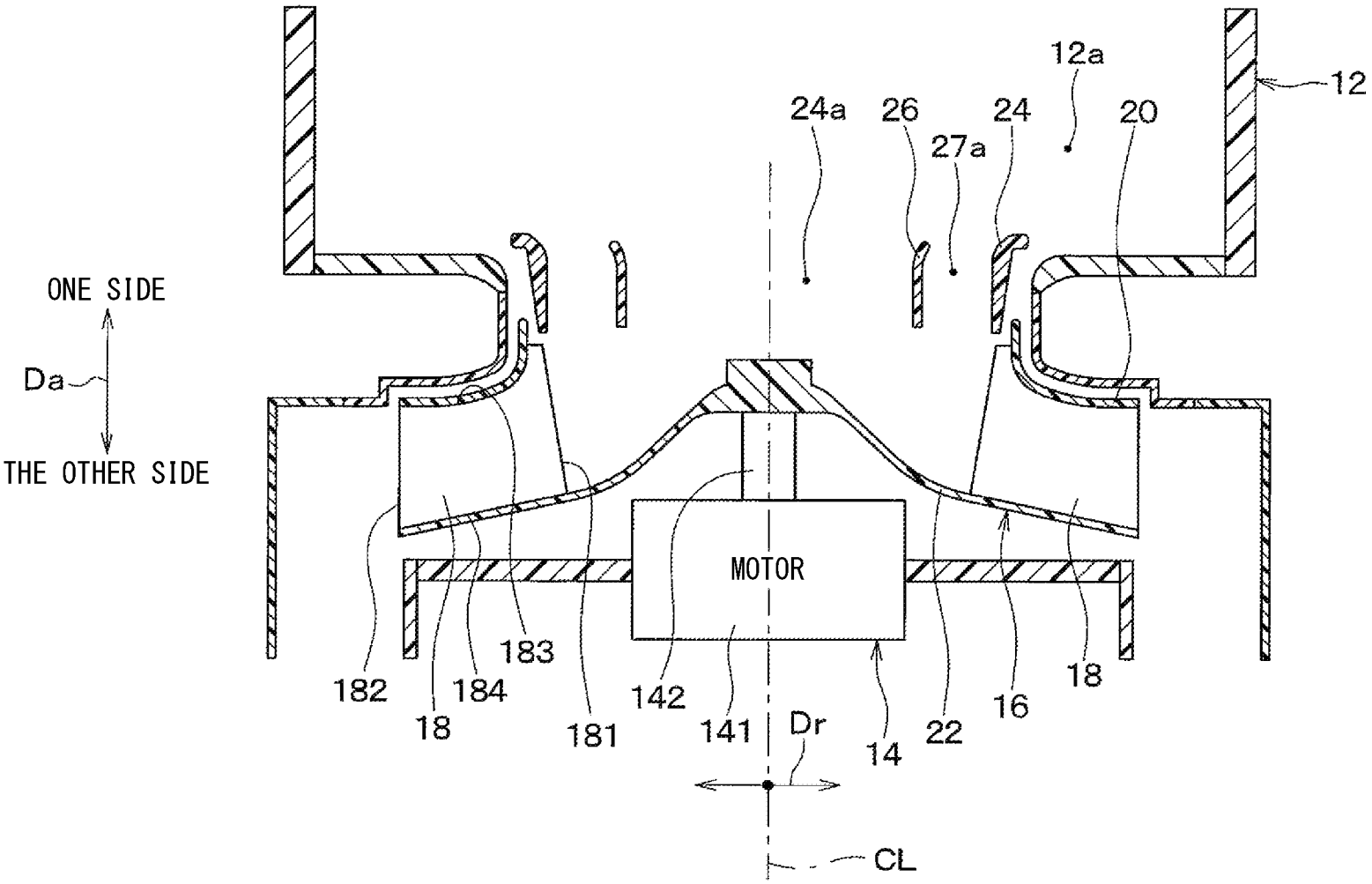
FIG. 22 is a cross-sectional view illustrating a longitudinal cross section obtained by cutting a blower along a virtual plane including a fan axis in a fourteenth embodiment, and is a view corresponding to FIG. 16.

As illustrated in FIG. 22, in the present embodiment, the partition 28 (see FIG. 16) is not provided. In this respect, the present embodiment is different from the twelfth embodiment.

Therefore, as compared with the case where the partition 28 is provided, the flow resistance of air in the guide inner flow path 27 can be reduced, and efficiency of the blower 10 can be improved.

The present embodiment is similar to the twelfth embodiment except for the above description. In the present embodiment, effects exhibited by components common to the above-described twelfth embodiment can be obtained as in the twelfth embodiment.

Although the present embodiment is a modification based on the twelfth embodiment, the present embodiment can be combined with the above-described thirteenth embodiment.

Fifteenth Embodiment

Next, a fifteenth embodiment will be described. In the present embodiment, differences from the above-described twelfth embodiment will be mainly described.

Figure 23:
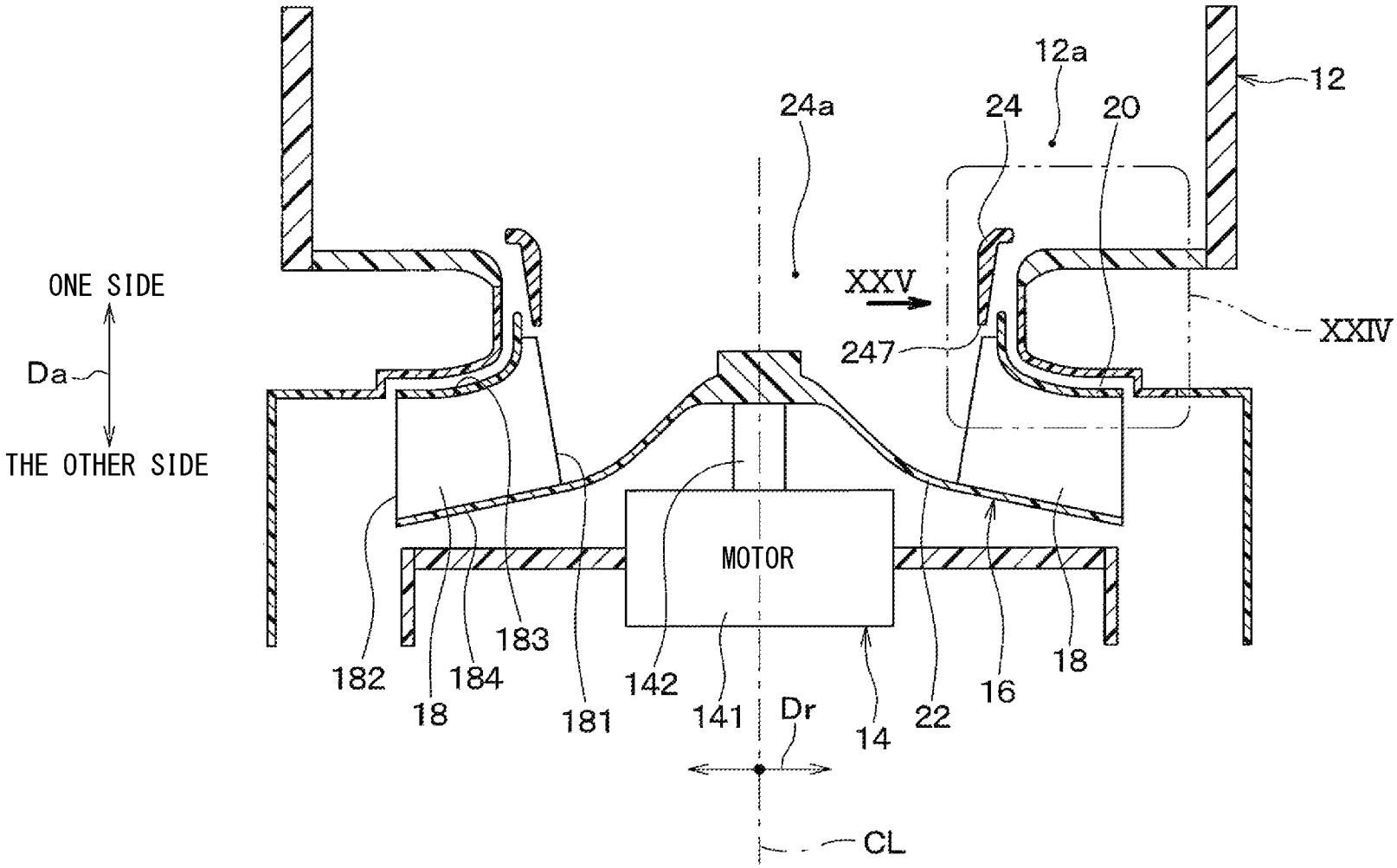
FIG. 23 is a cross-sectional view illustrating a longitudinal cross section obtained by cutting a blower along a virtual plane including a fan axis in a fifteenth embodiment, and is a view corresponding to FIG. 16.
Figure 24:
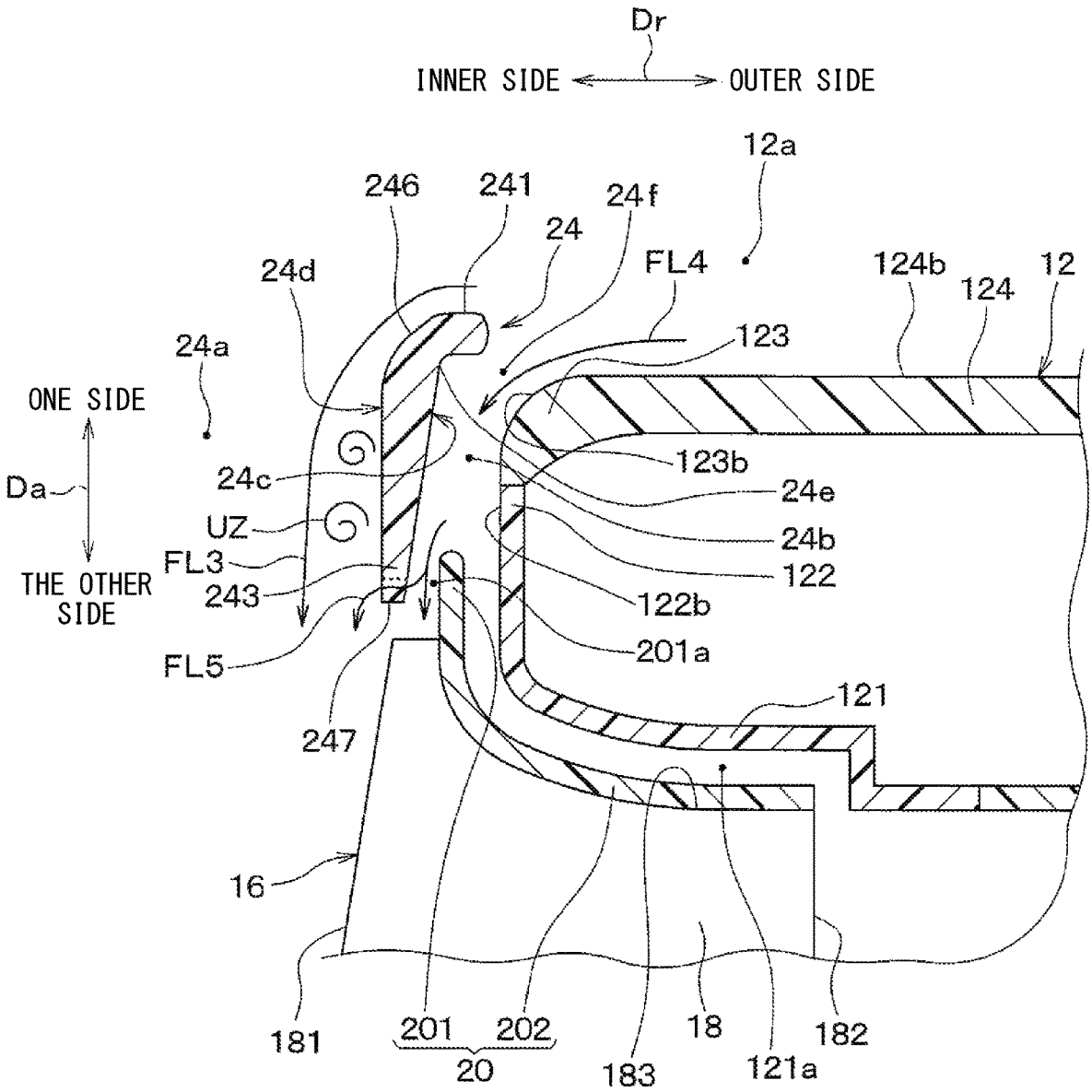
FIG. 24 is an enlarged cross-sectional view illustrating an enlarged XXIV portion of FIG. 23 in the fifteenth embodiment and is a view corresponding to FIG. 17.
Figure 25:
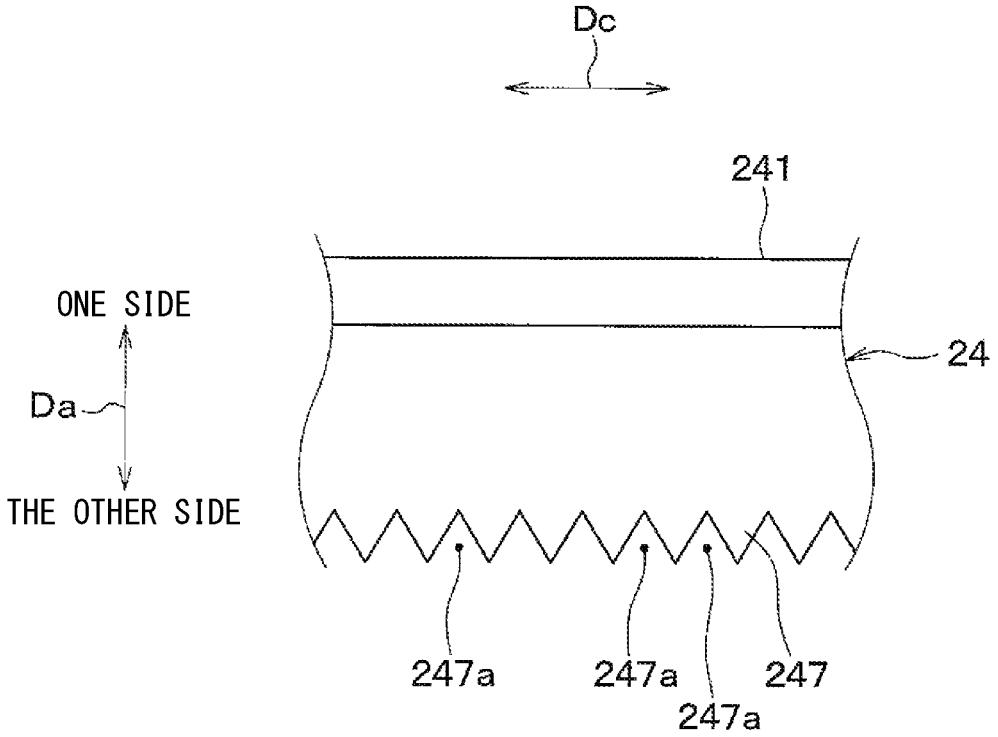
FIG. 25 is a view as viewed in a direction of an arrow XXV in FIG. 23 in the fifteenth embodiment.

As illustrated in FIGS. 23 to 25, in the present embodiment, the inner annular part 26 and the partition 28 (see FIG. 16) are not provided. The guide part 24 of the present embodiment has an uneven end edge portion 247 provided at the end on the other side in the fan axial direction Da. The present embodiment is different from the twelfth embodiment in these points.

Specifically, as illustrated in FIG. 25, the uneven end edge portion 247 has an uneven shape that is uneven in the fan axial direction Da while extending in the fan circumferential direction Dc. For example, the uneven shape is a shape in which V-shaped grooves 247*a* are continuous in the fan circumferential direction Dc. In the present embodiment, the uneven shape is formed over the entire circumference around the fan axis CL.

Therefore, as illustrated in FIGS. 23 to 25, an air flow on a radially outside of the guide part 24 as indicated by an arrow FL5 can be induced toward the air flow indicated by the arrow FL3 via the grooves 247*a* of the uneven end edge portion 247. That is, before the air flow along the negative pressure surface 24*d* of the guide part 24 passes through the negative pressure surface 24*d* toward the other side in the fan axial direction Da, the air flow on the radially outside of the guide part 24 can be induced toward the air flow via the grooves 247*a* of the uneven end edge portion 247.

Thus, a vortex UZ of air generated due to separation of air flow from the negative pressure surface 24*d* of the guide part 24 can be reduced near the uneven end edge portion 247. That is, the vortex UZ of air sucked into between the blades 18 can be reduced, and noise can be reduced.

Figure 26:
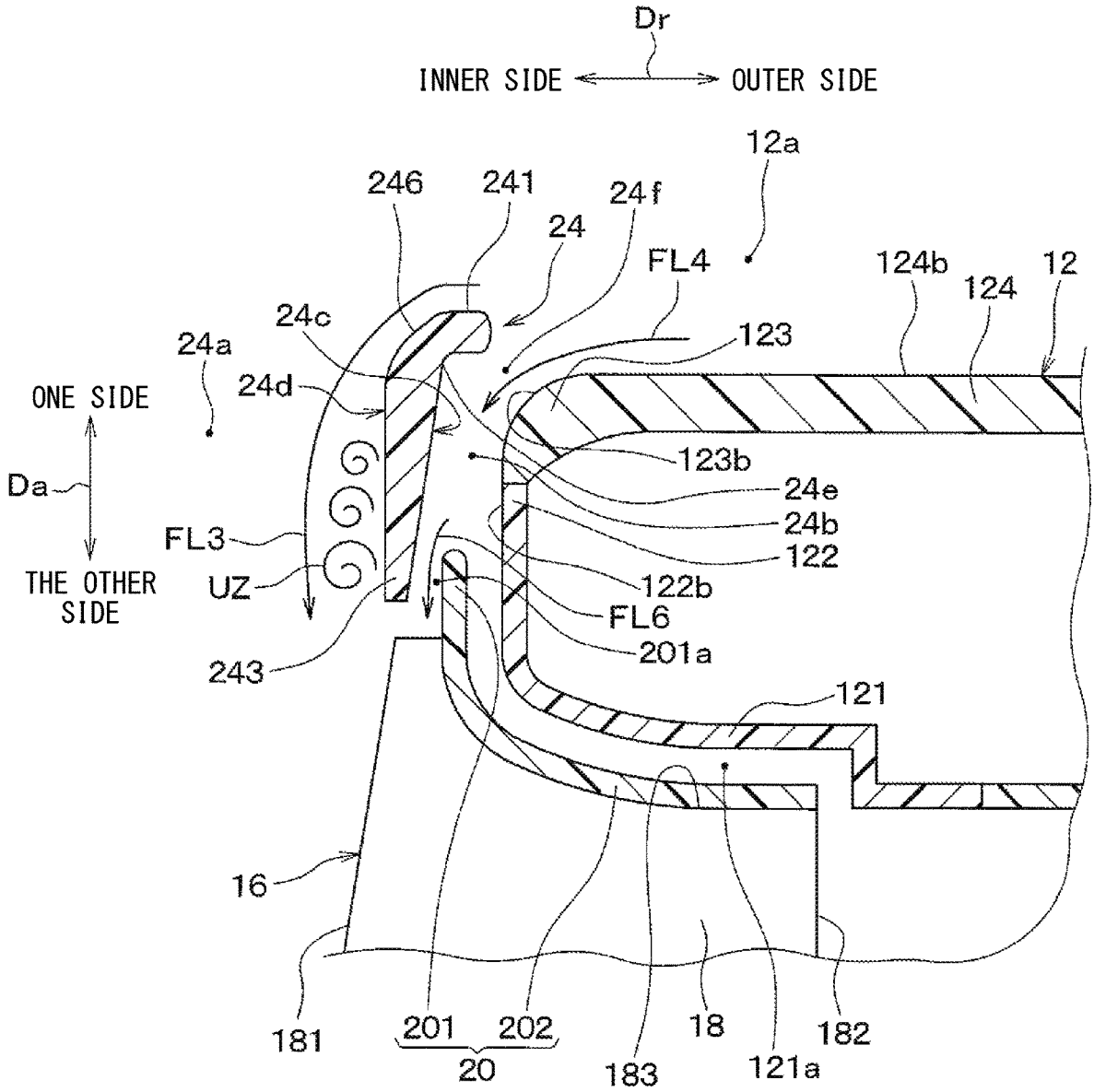
FIG. 26 is an enlarged sectional view illustrating a portion corresponding to the XXIV portion in FIG. 23 in an enlarged manner in a comparative example used to describe an effect in the fifteenth embodiment, and is a view corresponding to FIG. 24.

For example, in a comparative example in which the uneven end edge portion 247 is not provided as illustrated in FIG. 26, the air flowing through the gap 201*a* between the fan ring portion 201 and the guide part 24 as indicated by an arrow FL6 is not induced toward the negative pressure surface 24*d*. Thus, since there is no effect of reducing the vortex UZ of air generated due to separation of the air flow from the negative pressure surface 24*d* of the guide part 24, noise of the blower 10 tends to be larger than that in the present embodiment.

The present embodiment is similar to the twelfth embodiment except for the above description. In the present embodiment, effects exhibited by components common to the above-described twelfth embodiment can be obtained as in the twelfth embodiment.

Although the present embodiment is a modification based on the twelfth embodiment, the present embodiment can be combined with the thirteenth embodiment or the fourteenth embodiment described above.

Sixteenth Embodiment

Next, a sixteenth embodiment will be described. In the present embodiment, differences from the above-described twelfth embodiment will be mainly described.

Figure 27:
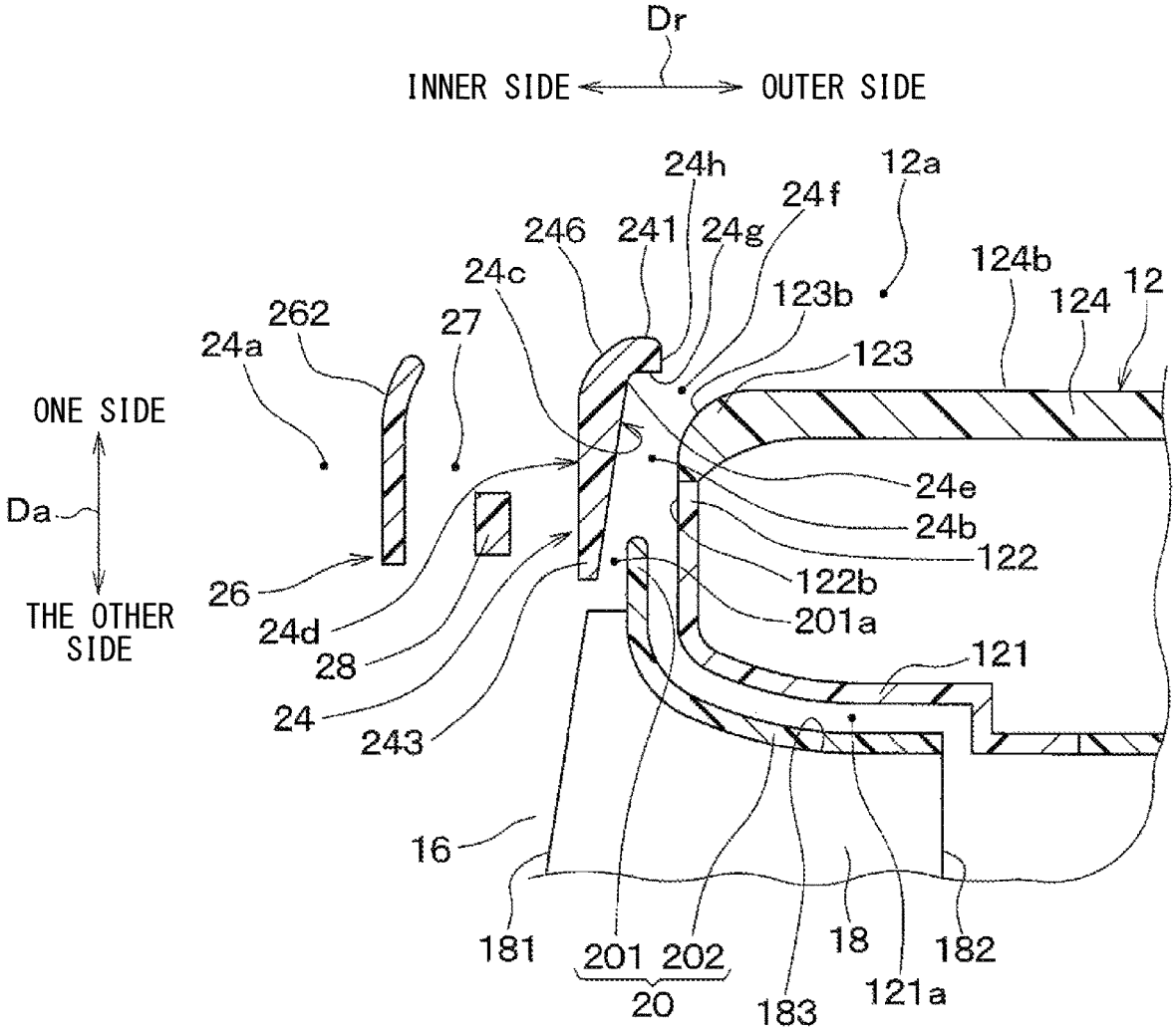
FIG. 27 is an enlarged cross-sectional view illustrating a portion corresponding to the XVII portion in FIG. 16 in an enlarged manner in a sixteenth embodiment, and is a view corresponding to FIG. 17.

As illustrated in FIG. 27, the entirety of the guide part 24 is arranged inside in the fan radial direction Dr with respect to the surface connecting portion 123*b* that is the bell mouth surface of the case 12. In other words, the guide part 24 does not include a portion provided to overlap with the surface connecting portion 123*b* in the fan axial direction Da. The positive pressure surface 24*c* of the guide part 24 has a shape in which the one side in the fan axial direction Da is curved so as to expand outward in the fan radial direction Dr in the longitudinal cross section of FIG. 27 that is a cross section including the fan axis CL. Thus, the positive pressure surface 24*c* has a surface 24*g* facing the other direction, which is a plane perpendicular to the fan axial direction Da, at the end on the one side in the fan axial direction Da. The surface 24*g* facing the other direction faces the other side in the fan axial direction Da. In these respects, the present embodiment is similar to the twelfth embodiment illustrated in FIG. 17.

However, the portion including the surface connecting portion 123*b* in the case 12 of the present embodiment and the guide part 24 are a single molded product integrally molded by, for example, injection molding or the like.

The guide part 24 has a radially outward surface 24*h* provided on the one side in the fan axial direction Da with respect to the surface 24*g* facing the other direction and on an outermost side in the fan radial direction Dr in the guide part 24. The radially outward surface 24*h* is a surface along the fan axial direction Da and faces outward in the fan radial direction Dr.

Further, the radially outward surface 24*h* is connected to the surface 24*g* facing the other direction on the other side in the fan axial direction Da of the radially outward surface 24*h*, and no corner R is provided between the surface 24*g* facing the other direction and the radially outward surface 24*h*. That is, the radially outward surface 24*h* is connected to the surface 24*g* facing the other direction as a surface along the fan axial direction Da.

With such a configuration of the guide part 24 and the case 12, it is possible to integrally mold at least the surface connecting portion 123*b* and the guide part 24 in the case 12 while avoiding deterioration of a mold releasing property of the mold.

The present embodiment is similar to the twelfth embodiment except for the above description. In the present embodiment, effects exhibited by components common to the above-described twelfth embodiment can be obtained as in the twelfth embodiment.

Although the present embodiment is a modification based on the twelfth embodiment, the present embodiment can be combined with any of the thirteenth to fifteenth embodiments described above.

OTHER EMBODIMENTS (1) In each of the above-described embodiments, the blower 10 is employed in, for example, a vehicle air conditioning unit, but the application of the blower 10 is not limited.

(2) In the first embodiment described above, as illustrated in FIG. 3, the fan ring portion 201 of the side plate 20 has a cylindrical shape or a substantially cylindrical shape, but the shape of the fan ring portion 201 is not limited thereto. For example, the fan ring portion 201 may have a tapered cylindrical shape having a diameter that is different depending on the position in the fan axial direction Da.

(3) In the above-described first embodiment, as illustrated in FIGS. 1 and 4, the guide part 24 is formed as, for example, a part different from the case 12, and is connected and fixed to the case 12 via the plurality of guide support portions 125, but this is an example. For example, the guide part 24, the plurality of guide support portions 125, and the case 12 may be integrally molded and configured as one component.

(4) In each of the above-described embodiments, for example, when viewed in a direction from one side to the other side in the fan axial direction Da as illustrated in FIG. 1, the communication path 24*b* has a uniform radial width and is provided over the entire circumference around the fan axis CL, but this is an example. For example, the radial width of the communication path 24*b* may be non-uniform as viewed in the direction.

(5) In each of the above-described embodiments, for example, as illustrated in FIG. 1, the communication path 24*b* is provided over the entire circumference around the fan axis CL, but it is also conceivable that the communication path is provided not over the entire circumference but only in a limited range in the fan circumferential direction Dc.

Figure 28:
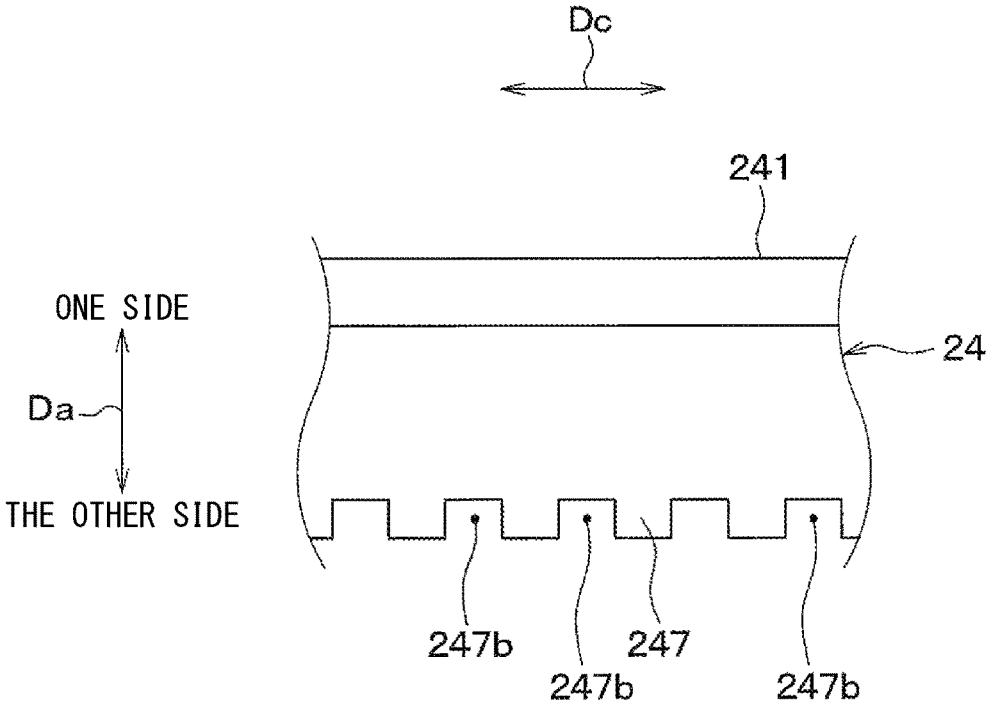
FIG. 28 is a view corresponding to an arrow view in the XXV direction in FIG. 23 in a first modification of the fifteenth embodiment, and is a view corresponding to FIG. 25.
Figure 29:
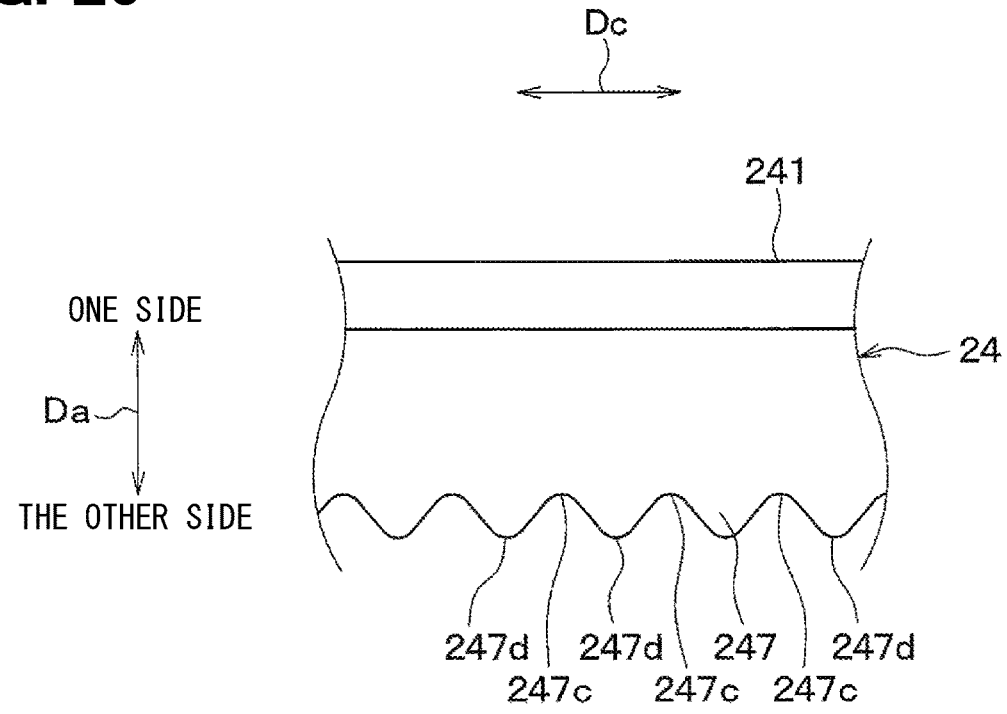
FIG. 29 is a view corresponding to an arrow view in the XXV direction in FIG. 23 in a second modification of the fifteenth embodiment, and is a view corresponding to FIG. 25.

(6) In the above-described fifteenth embodiment, as illustrated in FIG. 25, the uneven shape of the uneven end edge portion 247 is a shape in which the V-shaped grooves 247*a* are continuous in the fan circumferential direction Dc, but this is an example. For example, the uneven shape of the uneven end edge portion 247 may be a shape in which the rectangular groove 247*b* is continuous in the fan circumferential direction Dc as illustrated in FIG. 28. As illustrated in FIG. 29, the uneven shape of the uneven end edge portion 247 may be a shape in which concave shapes 247*c* curved to be concave in the fan axial direction Da and convex shapes 247*d* curved to bulge in the fan axial direction Da are sequentially and alternately continuous in the fan circumferential direction Dc.

(7) In the above-described fifteenth embodiment, as illustrated in FIG. 23, the blower 10 does not include the inner annular part 26 and the partition 28 (see FIG. 16), but may include the inner annular part 26 and the partition 28.

(8) In the above-described twelfth embodiment, as illustrated in FIG. 18, the certain circumferential range Rc in the fan circumferential direction Dc is one location, but may be a plurality of locations around the fan axis CL.

(9) It should be appreciated that the present disclosure is not limited to the embodiments described above and can be modified appropriately. The embodiments above are not irrelevant to one another and can be combined appropriately unless a combination is obviously impossible.

In the respective embodiments above, it goes without saying that elements forming the embodiments are not necessarily essential unless specified as being essential or deemed as being apparently essential in principle. In a case where a reference is made to the components of the respective embodiments as to numerical values, such as the number, values, amounts, and ranges, the components are not limited to the numerical values unless specified as being essential or deemed as being apparently essential in principle.

Also, in a case where a reference is made to the components of the respective embodiments above as to shapes and positional relations, the components are not limited to the shapes and the positional relations unless explicitly specified or limited to particular shapes and positional relations in principle.

(Overview)

According to a first aspect illustrated in part or all of the above embodiments, a communication path that allows an upstream space located on the one side in the axial direction with respect to the guide part to communicate with a gap between the fan ring portion and the guide part is formed outside the guide part in a radial direction of the fan axis. The fan ring portion is located outside in the radial direction with respect to an innermost peripheral portion located on an innermost side in the radial direction in the guide part.

According to a second aspect, the guide part has an overlapping portion provided to overlap with the fan ring portion on an inside in the radial direction, and an extension portion extending from the overlapping portion to the one side in the axial direction and provided on the one side in the axial direction with respect to the fan ring portion. Therefore, an air flow after merging of an air flow passing through the communication path and a backflow air flow flowing backward through an outside of a side plate can be guided along the direction of a main flow passing through a suction port in the gap between the overlapping portion and the fan ring portion.

According to a third aspect, the overlapping portion is arranged so as to face the fan ring portion with a gap. Therefore, it is easy to guide the air flow passing through the gap between the overlapping portion and the fan ring portion along the axial direction.

According to a fourth aspect, the communication path is provided over an entire circumference around the fan axis. Therefore, the merging of the air flow passing through the communication path and the backflow air flow flowing backward through the outside of the side plate can be uniformly generated over the entire circumference around the fan axis. Thus, for example, it is possible to suppress noise and the like that may be generated due to unevenness in the merging of the air flow passing through the communication path and the backflow air flow.

According to a fifth aspect, a cross-sectional shape of the guide part obtained by cutting along a plane including the fan axis is an airfoil shape having a positive pressure surface arranged outside in the radial direction and a negative pressure surface arranged inside in the radial direction. Therefore, the operation of the positive pressure surface increases the pressure (in other words, atmospheric pressure) of the air passing through the communication path. The air pressure on the downstream side of the backflow air flow is also increased by the merging of the air flow passing through the communication path and the backflow air flow. Consequently, the pressure difference between the air pressure on the upstream side and the air pressure on the downstream side of the backflow air flow is reduced, so that the air flow rate of the backflow air flow can be reduced.

According to a sixth aspect, a cross-sectional shape of the guide part obtained by cutting along a plane including the fan axis is a plate shape. The guide part extends from the other side opposite to the one side in the axial direction to the one side while bending to expand outward in the radial direction. Therefore, for example, as compared with a case where one end side of the guide part is parallel to the axial direction, a part of the air flowing toward the suction port along the air guide surface can be smoothly guided to the communication path by the guide part.

According to a seventh aspect, the blower includes a guide outside arrangement portion, and the guide outside arrangement portion is provided on the one side in the axial direction with respect to the fan ring portion and provided outside in the radial direction with respect to the guide part. A cross-sectional shape of the guide part obtained by cutting along a plane including the fan axis is a plate shape extending in the axial direction, and a gap between the guide part and the guide outside arrangement portion is the communication path. Therefore, it is possible to provide the communication path by, for example, adding the guide part to the guide outside arrangement portion while securing the maximum opening area of the suction port through which the main flow passes.

According to an eighth aspect, the blower includes a case including the guide outside arrangement portion, and the guide outside arrangement portion has an inward surface that faces inward in the radial direction. The case has an air guide surface that faces the one side in the axial direction and guides air to the suction port, and a surface connecting portion that connects the air guide surface and the inward surface between the air guide surface and the inward surface. The guide part has one end on the one side in the axial direction, and the one end is located on the one side in the axial direction with respect to the surface connecting portion. Therefore, as compared with a case where the positional relationship between the one end of the guide part and the surface connecting portion is not as above, a part of the air flowing toward the suction port along the air guide surface is easily guided to the communication path by the guide part.

According to a ninth aspect, the blower includes an inner annular part that is annular and formed around the fan axis. The fan is a turbo fan, and the inner annular part is arranged inside in the radial direction with respect to the guide part, and forms a guide inner flow path, which penetrates in the axial direction and through which air flows, between the inner annular part and the guide part. Therefore, since the flow resistance of air in the guide inner flow path increases as compared with the case where there is no inner annular part, the air flow of the suction port is suppressed from concentrating on the surface of the guide part. Thus, it is possible to reduce separation of the air flow generated on a radially inner surface of the guide part, and it is possible to suppress worsening of noise of the blower.

According to a tenth aspect, the inner annular part has a shape in which the one side in the axial direction expands in diameter with respect to the other side. Therefore, for example, as compared with a case where the other side in the axial direction of the inner annular part expands in diameter with respect to the one side, it is possible to suppress separation of the air flow flowing into a radially inside of the inner annular part from the surface of the inner annular part.

According to an eleventh aspect, the inner annular part has, on the one side in the axial direction in the inner annular part, a tapered annular portion inner surface that faces inward in the radial direction and is tapered to expand more outward in the radial direction as it is farther on the one side in the axial direction. The guide part has, on the one side in the axial direction in the guide part, a tapered guide inner surface that faces inward in the radial direction and is tapered to expand more outward in the radial direction as it is farther on the one side in the axial direction. A taper angle of the tapered guide inner surface at an end on the one side in the axial direction in the tapered guide inner surface is larger than a taper angle of the tapered annular portion inner surface at an end on the one side in the axial direction in the tapered annular portion inner surface. Therefore, the air flow along the tapered guide inner surface can be restricted to some extent by the inner annular part, so that it is possible to suppress separation of the air flow from the surface of the guide part on or near the tapered guide inner surface.

According to a twelfth aspect, the blower includes a partition, the partition is provided between the guide part and the inner annular part and partitions the guide inner flow path into a plurality of flow paths. In a flow rate distribution of air flowing to the suction port on an air flow upstream side with respect to the suction port, a flow rate of the air flowing to the suction port is larger in a certain circumferential range in the circumferential direction than in a periphery of the certain circumferential range. The partition partitions the guide inner flow path more finely in the certain circumferential range in the circumferential direction than in the periphery of the certain circumferential range. Thus, the partition can provide a difference in flow resistance of air in the guide inner flow path in the circumferential direction. Therefore, as compared with the case where the partition is not provided, unevenness of the flow rate distribution of air on the air flow upstream side with respect to the suction port is smaller in the guide inner flow path. Consequently, the flow velocity unevenness generated in the circumferential direction in the flow velocity distribution of the air flowing through the guide inner flow path is reduced, and it is possible to suppress worsening of noise of the blower.

According to a thirteenth aspect, in the axial direction, the inner annular part falls within a range occupied by the guide part in the axial direction.

According to a fourteenth aspect, the guide part has an uneven end edge portion provided at an end on the other side opposite to the one side in the axial direction, and the uneven end edge portion has an uneven shape that is uneven in the axial direction while extending in the circumferential direction. Therefore, with respect to the air flow along the radially inner surface of the guide part, the air flow on the radially outside of the guide part can be induced via a concave portion of the uneven end edge portion of the guide part before the air flow passes through the surface of the guide part toward the other side in the axial direction. Thus, a vortex of air generated due to separation of the air flow from the radially inner surface of the guide part can be reduced near the uneven end edge portion. That is, the vortex of air sucked into between the blades can be reduced, and noise can be reduced.

According to a fifteenth aspect, the uneven shape is a shape in which V-shaped grooves are continuous in the circumferential direction, a shape in which rectangular grooves are continuous in the circumferential direction, or a shape in which a concave shape curved to be concave in the axial direction and a convex shape curved to bulge in the axial direction are sequentially and alternately continuous in the circumferential direction.

According to a sixteenth aspect, the guide part has a guide inner peripheral surface provided inside in the radial direction and a guide outer peripheral surface provided outside in the radial direction. Each of the guide inner peripheral surface and the guide outer peripheral surface has a shape in which the one side in the axial direction is curved to expand outward in the radial direction in a cross section including the fan axis. In the cross section including the fan axis, a minimum value of a radius of curvature of the guide inner peripheral surface is larger than a minimum value of a radius of curvature of the guide outer peripheral surface. Therefore, the air flow along the guide inner peripheral surface gently bends, so that it is possible to suppress separation of the air flow from the guide inner peripheral surface.

According to a seventeenth aspect, a case of the blower has an inward surface that is provided outside in the radial direction with respect to the guide part, faces inward in the radial direction, and forms the communication path with the guide part, and an air guide surface that faces the one side in the axial direction and guides air to the suction port. Further, the case has a surface connecting portion that connects the air guide surface and the inward surface between the air guide surface and the inward surface. The surface connecting portion is formed as a bell mouth surface curved to continuously connect the air guide surface and the inward surface in a cross section including the fan axis, and the guide outer peripheral surface has a facing portion that faces the bell mouth surface. In a cross section including the fan axis, the facing portion includes a portion having a radius of curvature smaller than a minimum value of a radius of curvature of the bell mouth surface. Therefore, it is possible to reduce the flow velocity of air along the facing portion between the facing portion and the bell mouth surface as compared with the case where the facing portion is not as above. When the flow velocity of air decreases, the flow velocity of air in the communication path also decreases, so that the static pressure of air in the communication path can be increased accordingly. When the static pressure of air in the communication path increases in this manner, the static pressure difference between the vicinity of the trailing edge of the blade and the communication path decreases, and it is possible to reduce the air flow rate of the backflow air flow flowing backward through the outside of the side plate.

According to an eighteenth aspect, the guide inner peripheral surface is formed to decrease more in diameter from an end on the one side toward the other side of the guide inner peripheral surface in the axial direction and to have a minimum diameter in a middle of reaching an end on the other side. Therefore, it is possible to cause the air flowing into the suction port having a speed component directed radially inward to be directed in the direction along the axial direction while smoothly correcting the flow direction of air along the guide inner peripheral surface. A nineteenth aspect is similar to the eighteenth aspect.

According to a twentieth aspect, a radius of curvature of the guide inner peripheral surface decreases more as it is farther on the one side in the axial direction in a cross section including the fan axis.

According to a twenty-first aspect, the gap between the fan ring portion and the guide part is formed to widen more as it is farther on the other side opposite to the one side in the axial direction. Therefore, the flow velocity of air flowing through the gap can be reduced more as it is farther on the other side in the axial direction. Thus, when the air flowing out from the gap and the air flowing on the radially inside of the guide part merge, the flow velocity difference of the air is reduced, so that turbulence of the air flow can be reduced.

According to a twenty-second aspect, the guide part has one end on the one side in the axial direction, and the one end is located on the one side in the axial direction with respect to the surface connecting portion of the case. Therefore, as compared with a case where the positional relationship between the one end of the guide part and the surface connecting portion is not as above, a part of the air flowing toward the suction port along the air guide surface is easily guided to the communication path by the guide part.

Further, according to a twenty-third aspect, the communication path has an upstream end connected to the upstream space. The communication path is formed with a path cross-sectional area that is minimum at the upstream end in the communication path. Therefore, for example, as compared with a case where the path cross-sectional area in the communication path is uniform, it is possible to reduce the flow velocity of air on the air flow downstream side with respect to the upstream end in the communication path. As the flow velocity of air decreases, it is possible to increase the static pressure of air at the position of merging with the backflow air flow in the communication path. When the static pressure of air in the communication path increases in this manner, the static pressure difference between the vicinity of the trailing edge of the blade and the communication path decreases, and the air flow rate of the backflow air flow can be reduced.

Further, according to a twenty-fourth aspect, the entirety of the guide part is arranged inside in the radial direction with respect to the surface connecting portion, and the guide part has a guide outer peripheral surface provided outside in the radial direction. The guide outer peripheral surface has a shape in which the one side in the axial direction is curved so as to expand outward in the radial direction in a cross section including the fan axis. The guide outer peripheral surface has a surface perpendicular to the axial direction at the end on one side in the axial direction. Therefore, it is possible to integrally mold at least the surface connecting portion and the guide part in the case while avoiding deterioration of a mold releasing property of the mold.

What is claimed is:

1. A blower comprising:

a fan that includes a plurality of blades arranged side by side in a circumferential direction around a fan axis, and a side plate to which an end of each of the plurality of blades is connected, the side plate including a fan ring portion having a cylindrical shape centered around the fan axis, the fan configured to rotate around the fan axis to blow out air sucked from one side in an axial direction of the fan axis with respect to the fan ring portion through an inside of the fan ring portion and between the plurality of blades;

a guide part that is annular and arranged on the one side in the axial direction relative to the fan ring portion, the guide part having a suction port through which the air sucked into the fan passes; and a side plate facing portion arranged opposite to the plurality of blades with respect to the side plate to form a first gap between the side plate facing portion and the side plate by extending along the side plate, wherein a communication path that allows an upstream space located on the one side in the axial direction with respect to the guide part to communicate with a second gap defined radially between the fan ring portion and the guide part is formed outside the guide part in a radial direction of the fan axis, the fan ring portion is located outside in the radial direction with respect to an innermost peripheral portion of the guide part located on an innermost side in the radial direction, and an end of the first gap on the one side in the axial direction is connected to the communication path and open to the communication path towards the one side in the axial direction.

2. A blower comprising:

a fan that includes a plurality of blades arranged side by side in a circumferential direction around a fan axis, and a side plate to which an end of each of the plurality of blades is connected, the side plate including a fan ring portion having a cylindrical shape centered around the fan axis, the fan configured to rotate around the fan axis to blow out air sucked from one side in an axial direction of the fan axis with respect to the fan ring portion through an inside of the fan ring portion and between the plurality of blades; and a guide part that is annular and arranged on the one side in the axial direction relative to the fan ring portion, the guide part having a suction port through which the air sucked into the fan passes, wherein a communication path that allows an upstream space located on the one side in the axial direction with respect to the guide part to communicate with a gap defined radially between the fan ring portion and the guide part is formed outside the guide part in a radial direction of the fan axis, the fan ring portion is located outside in the radial direction with respect to an innermost peripheral portion of the guide part located on an innermost side in the radial direction, and the guide part has an overlapping portion provided to overlap with the fan ring portion in the radial direction, and an extension portion extending from the overlapping portion towards the one side in the axial direction with respect to the fan ring portion.

3. The blower according to claim 2, wherein the overlapping portion of the guide part is arranged so as to face the fan ring portion such that the gap is defined radially between the overlapping portion of the guide part and the fan ring portion.

4. The blower according to claim 1, wherein the communication path is provided over an entire circumference around the fan axis, the guide part has an overlapping portion provided to overlap with the fan ring portion in the radial direction, and an extension portion extending from the overlapping portion to the one side in the axial direction and provided on the one side in the axial direction with respect to the fan ring portion, and the second gap is located radially between the overlapping portion of the guide part and the fan ring portion.

5. The blower according to claim 1, wherein a cross-sectional shape of the guide part obtained by cutting along a plane including the fan axis is an airfoil shape having a positive pressure surface arranged outside in the radial direction and a negative pressure surface arranged inside in the radial direction.

6. The blower according to claim 1, wherein a cross-sectional shape of the guide part obtained by cutting along a plane including the fan axis is a plate shape, and the guide part is curved to expand outward in the radial direction by extending from a side opposite to the one side in the axial direction towards the one side.

7. The blower according to claim 1, further comprising a guide outside arrangement portion provided on the one side in the axial direction with respect to the fan ring portion and provided outside in the radial direction with respect to the guide part, wherein a cross-sectional shape of the guide part obtained by cutting along a plane including the fan axis is a plate shape extending in the axial direction, the communication path is defined between the guide part and the guide outside arrangement portion, the fan ring portion has one end located on the one side in the axial direction, the first gap and the communication path merge with each other at a radially outer side of the one end of the fan ring portion, and the second gap and the communication path merge with each other at a radially inner side of the one end of the fan ring portion.

8. The blower according to claim 7, further comprising a case including the guide outside arrangement portion, wherein the guide outside arrangement portion has an inward surface that faces inward in the radial direction, the case has an air guide surface that faces the one side in the axial direction and guides air to the suction port, and a surface connecting portion that connects the air guide surface and the inward surface between the air guide surface and the inward surface, the guide part has one end on the one side in the axial direction, and the one end of the guide part is located on the one side in the axial direction with respect to the surface connecting portion.

9. The blower according to claim 1, further comprising an inner annular part that is annular and formed around the fan axis, wherein the fan is a turbo fan, and the inner annular part is arranged inside in the radial direction with respect to the guide part, and forms a guide inner flow path, which extends in the axial direction and through which air flows, between the inner annular part and the guide part.

10. The blower according to claim 9, wherein the inner annular part has a shape in which the one side in the axial direction is larger in diameter than an opposite other side is.

11. The blower according to claim 9, wherein the inner annular part has a tapered annular portion inner surface on the one side in the axial direction to face inward in the radial direction and be tapered to expand outward in the radial direction by extending towards the one side in the axial direction, the guide part has a tapered guide inner surface on the one side in the axial direction to face inward in the radial direction and be tapered to expand outward in the radial direction by extending towards the one side in the axial direction, and a taper angle of the tapered guide inner surface on the one side in the axial direction is larger than a taper angle of the tapered annular portion inner surface on the one side in the axial direction.

12. The blower according to claim 9, further comprising a partition that is provided radially between the guide part and the inner annular part and partitions the guide inner flow path into a plurality of flow paths, wherein a flow rate of the air flowing to the suction port is larger in a certain circumferential range in the circumferential direction than in a periphery of the certain circumferential range, with respect to a flow rate distribution of the air flowing to the suction port, and the partition partitions the guide inner flow path more finely in the certain circumferential range in the circumferential direction than in the periphery of the certain circumferential range.

13. The blower according to claim 9, wherein the inner annular part falls within a range occupied by the guide part in the axial direction.

14. The blower according to claim 1, wherein an end of the guide part on the other-a side opposite to the one side in the axial direction has an uneven end edge portion, and the uneven end edge portion has an uneven shape that is uneven in the axial direction while extending in the circumferential direction.

15. The blower according to claim 14, wherein the uneven shape is formed by V-shaped grooves continuous in the circumferential direction, rectangular grooves continuous in the circumferential direction, or a concave shape curved to be concave in the axial direction and a convex shape curved to bulge in the axial direction sequentially and alternately continuous in the circumferential direction.

16. The blower according to claim 1, wherein the guide part has a guide inner peripheral surface provided inside in the radial direction and a guide outer peripheral surface provided outside in the radial direction, each of the guide inner peripheral surface and the guide outer peripheral surface has a shape in which the one side in the axial direction is curved to expand outward in the radial direction and a cross-section parallel to the fan axis, and a minimum value of a radius of curvature of the guide inner peripheral surface is larger than a minimum value of a radius of curvature of the guide outer peripheral surface in the cross-section parallel to the fan axis.

17. The blower according to claim 16, further comprising a case having an inward surface that is provided outside in the radial direction with respect to the guide part, faces inward in the radial direction, and forms the communication path radially between the inward surface and the guide part, an air guide surface that faces the one side in the axial direction and guides air to the suction port, and a surface connecting portion that connects the air guide surface and the inward surface between the air guide surface and the inward surface, wherein the surface connecting portion is formed as a bell mouth surface curved to continuously connect the air guide surface and the inward surface, the guide outer peripheral surface has a facing portion that faces the bell mouth surface, and a part of the facing portion of the guide outer peripheral surface has a radius of curvature smaller than a minimum value of a radius of curvature of the bell mouth surface.

18. The blower according to claim 16, wherein the guide inner peripheral surface is formed to decrease in diameter by extending from the one side in the axial direction towards an opposite other side in the axial direction and to have a minimum diameter located proximate to the other side.

19. The blower according to claim 9, wherein the guide part has a guide inner peripheral surface provided inside in the radial direction, and the guide inner peripheral surface is formed to decrease in diameter by extending from the one side in the axial direction towards an opposite other side in the axial direction and to have a minimum diameter located proximate to the other side.

20. The blower according to claim 16, wherein the radius of curvature of the guide inner peripheral surface decreases by extending towards the one side in the axial direction in the cross-section parallel to the fan axis.

21. The blower according to claim 9, wherein the second gap defined radially between the fan ring portion and the guide part is formed to widen on an other side opposite to the one side in the axial direction.

22. The blower according to claim 9, further comprising a case having an inward surface that is provided outside in the radial direction with respect to the guide part, faces inward in the radial direction, and forms the communication path radially between the inward surface and the guide part, an air guide surface that faces the one side in the axial direction and guides air to the suction port, and a surface connecting portion that connects the air guide surface and the inward surface between the air guide surface and the inward surface, wherein the guide part has one end on the one side in the axial direction, and the one end of the guide part is located on the one side in the axial direction with respect to the surface connecting portion.

23. The blower according to claim 9, wherein the communication path has an upstream end connected to the upstream space, and the communication path is formed with a path cross-sectional area that is minimum at the upstream end of the communication path.

24. The blower according to claim 9, further comprising a case having an inward surface that is provided outside in the radial direction with respect to the guide part, faces inward in the radial direction, and forms the communication path radially between the inward surface and the guide part, an air guide surface that faces the one side in the axial direction and guides air to the suction port, and a surface connecting portion that connects the air guide surface and the inward surface between the air guide surface and the inward surface, wherein an entirety of the guide part is arranged inside in the radial direction with respect to the surface connecting portion, the guide part has a guide outer peripheral surface provided outside in the radial direction, the guide outer peripheral surface has a shape in which the one side in the axial direction is curved so as to expand outward in the radial direction and a cross-section parallel to the fan axis, and the guide outer peripheral surface has a surface portion perpendicular to the axial direction at the one side in the axial direction.

* * * * *